United States Patent [19]

Hasegawa et al.

[11] 4,445,482

[45] May 1, 1984

[54] AIR/FUEL RATION FEEDBACK CONTROL SYSTEM ADAPTED TO OBTAIN STABLE ENGINE OPERATION UNDER PARTICULAR ENGINE OPERATING CONDITIONS

[75] Inventors: Shumpei Hasegawa, Niiza; Noriyuki Kishi, Itabashi, both of Japan

[73] Assignee: Honda Giken Kogyo Kabushiki Kaisha, Tokyo, Japan

[21] Appl. No.: 376,106

[22] Filed: May 7, 1982

[30] Foreign Application Priority Data

May 15, 1981 [JP] Japan ..... 56-72991

[51] Int. Cl.[3] ..... F02M 51/00; F02D 5/00

[52] U.S. Cl. ..... 123/489; 123/491; 123/493

[58] Field of Search ..... 123/489, 480, 478, 483, 123/491, 440

[56] References Cited

U.S. PATENT DOCUMENTS

| | | | |
|---|---|---|---|
| 3,483,851 | 12/1969 | Reichardt | 123/491 |
| 4,354,238 | 10/1982 | Manaka et al. | 123/489 |
| 4,359,993 | 11/1982 | Carlson | 123/493 |
| 4,383,515 | 5/1983 | Higashiyama et al. | 123/489 |

*Primary Examiner*—Raymond A. Nelli
*Attorney, Agent, or Firm*—Lyon & Lyon

[57] ABSTRACT

An air/fuel ratio feedback control system adapted to control the air/fuel ratio of an air/fuel mixture being supplied to an internal combustion engine, by the use of a first coefficient having a value variable in response to actual exhaust gas concentration and at least one second coefficient having a value variable in dependence on the kind of a particular operating condition or region in which the engine is operating. The control system is operable such that when the engine is operating in an operating condition other than predetermined particular operating conditions of the engine, the value of the first coefficient is varied in response to the output of an exhaust gas concentration sensor, and simultaneously the value of the second coefficient is held at a first predetermined value, and when the engine is operating in one of the predetermined particular operating conditions, the value of the second coefficient is held at a second predetermined value, and simultaneously the value of the first coefficient at a third predetermined value which is a mean value of values of the first coefficient obtained when the engine is operating in the above operating condition other than the particular operating conditions.

22 Claims, 18 Drawing Figures

| FIG. 5A | FIG. 5B |
|---|---|

| FIG. 9A | FIG. 9B |
|---|---|

| FIG. 14A | FIG. 14B |
|---|---|

AIR/FUEL RATION FEEDBACK CONTROL SYSTEM ADAPTED TO OBTAIN STABLE ENGINE OPERATION UNDER PARTICULAR ENGINE OPERATING CONDITIONS

BACKGROUND OF THE INVENTION

This invention relates to an air/fuel ratio feedback control system for performing by electronic means feedback control of the air/fuel ratio of an air/fuel mixture being supplied to an internal combustion engine, and more particularly to an air/fuel ratio feedback control system of this kind, which is capable of positively controlling the air/fuel ratio to a predetermined value best suited for a particular operating condition of the engine when the engine is operating in the particular operating condition, to thereby achieve improved operational stability and driveability of the engine.

A fuel supply control system adapted for use with an internal combustion engine, particularly a gasoline engine has been proposed e.g. by U.S. Pat. No. 3,483,851, which is adapted to determine the valve opening period of a fuel quantity metering or adjusting means for control of the fuel injection quantity, i.e. the air/fuel ratio of an air/fuel mixture being supplied to the engine, by first determining a basic value of the above valve opening period as a function of engine rpm and intake pipe absolute pressure and then adding to and/or multiplying same by constants and/or coefficients being dunctions of engine rpm, intake pipe absolute pressure, engine temperature, throttle valve opening, exhaust gas ingredient concentration (oxygen concentration), etc., by electronic computing means.

Also, in an engine having a three-way catalyst arranged in its exhaust system, it is generally employed to control the air/fuel ratio of the mixture to a theoretical mixture ratio in a feedback manner responsive to the output of an exhaust gas concentration sensor which may be represented by an $O_2$ sensor, arranged in the exhaust system of the engine, to obtain the best conversion efficiency of unburned hydrocarbons, carbon monoxide and nitrous oxides in the exhaust gases emitted from the engine. However, this feedback control based upon the output of the exhaust gas sensor cannot be applied when the engine is operating in a particular operating condition such as engine idle, wide-open-throttle where the air/fuel ratio of the mixture needs to be controlled to a value different from the theoretical mixture ratio.

Therefore, in the case of applying the above exhaust gas concentration-based feedback to the aforementioned fuel supply control system using coefficients, etc., it is necessary to carry out open-loop control when the engine is operating in such particular operating condition, by using a coefficient having a predetermined value corresponding to the particular operating condition, so as to achieve a desired predetermined air/fuel ratio best suited for engine operating under the above particular operating condition.

It is thus desirable that the predetermined air/fuel ratio corresponding to the particular operating condition can be achieved with certainty by means of open-loop control. However, as a matter of fact, the actual air/fuel ratio can sometimes have a value different from the desired predetermined value due to variations in the performance of various sensors for detecting the operating condition of the engine and a system for controlling or driving the fuel quantity metering or adjusting means. In such event, it is impossible to obtain required operational stability and driveability of the engine.

OBJECT AND SUMMARY OF THE INVENTION

It is the object of the invention to provide an air/fuel ratio feedback control system for use with an internal combustion engine, which is capable of controlling the air/fuel ratio of the mixture to a predetermined value or a value very close thereto corresponding to a particular operating condition of the engine, when the engine is operating in the above particular operating condition, to thereby assure achievement of required operational stability and driveability of the engine.

The present invention provides an air/fuel ratio feedback control system for use with an internal combustion engine, which is adapted to control the air/fuel ratio of an air/fuel mixture being supplied to the engine, by the use of a first coefficient having a value variable in response to the output of an exhaust gas concentration sensor arranged in the exhaust system of the engine, and at least one second coefficient having a value variable in dependence on the kind of a particular operating condition in which the engine is operating. The control system is characterized by including an electric circuit means which is operable such that when the engine is operating in an operating condition (i.e. feedback control region) other than predetermined particular operating conditions of the engine, the value of the first coefficient is varied in response to the output of the exhaust gas concentration sensor, and simultaneously the value of the second coefficient is held at a first predetermined value, and when the engine is operating in one of the predetermined particular operating conditions, the value of the second coefficient is held at a second predetermined value which is a mean value of values of the first coefficient obtained during engine operation under the above operating condition, i.e. feedback control region other than the particular operating conditions. Thus, during open-loop control under a particular operating condition of the engine, the use of the first coefficient having its value held at the third predetermined or means value in addition to the second coefficient having its value held at the second predetermined value makes it possible to obtain an air/fuel ratio more closer to a desired air/fuel ratio best suited for engine operation in the particular operating condition of the engine, obtaining improved operational stability and driveability of the engine.

Preferably, the above mean value at which the first coefficient is to be held comprises a mean value of values of the first coefficient each assumed immediately before or after a proportional term control action which is performed during air/fuel ratio feedback control.

Also preferably, an up-to-date value of the first coefficient is used for calculation of the above mean value, each time it is obtained immediately before or after each proportional term control action. Thus, a mean value of the first coefficient can always be obtained which is an up-to-date value and which represents a mean value obtained at an instant when the actual air/fuel ratio of the mixture assumes a value most close to the theoretical mixture ratio, making it possible to carry out air/fuel ratio control fully responsive to the present operating condition of the engine, in an accurate manner.

The above and other objects, features and advantages of the invention will be more apparent from the ensuing detailed description taken in connection with the accompanying drawings in which:

DETAILED DESCRIPTION

The present invention will now be described in detail with reference to the drawings.

Figure 1:
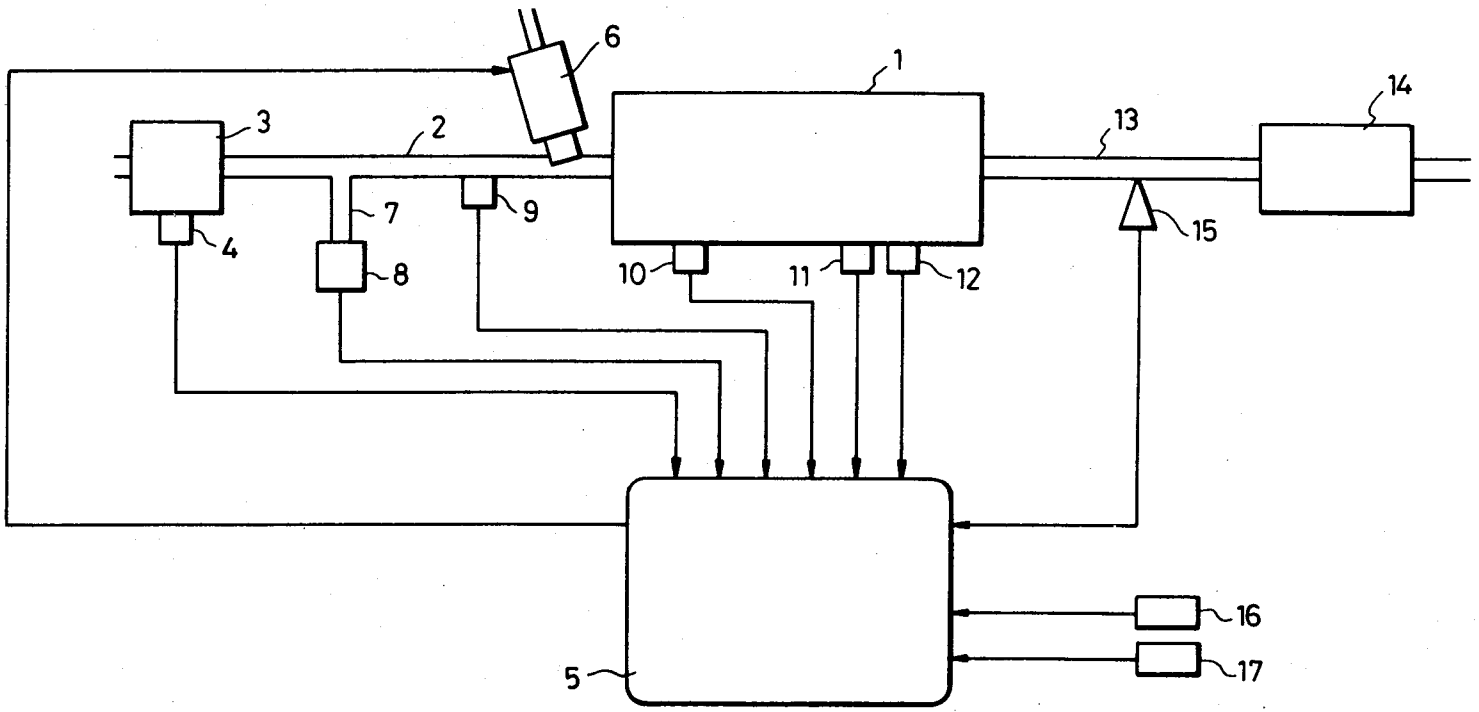
FIG. 1 is a block diagram illustrating the whole arrangement of an air/fuel ratio feedback control system according to the present invention.

Referring first to FIG. 1, there is illustrated the whole arrangement of a fuel supply control system for internal combustion engines, to which the present invention is applicable. Reference numeral 1 designates an internal combustion engine which may be a four-cylinder type, for instance. This engine 1 has main combustion chambers which may be four in number and sub combustion chambers communicating with the main combustion chambers, none of which is shown. An intake pipe 2 is connected to the engine 1, which comprises a main intake pipe communicating with each main combustion chamber, and a sub intake pipe with each sub combustion chamber, respectively, neither of which is shown. Arranged across the intake pipe 2 is a throttle body 3 which accommodates a main throttle valve and a sub throttle valve mounted in the main intake pipe and the sub intake pipe, respectively, for synchronous operation. Neither of the two throttle valves is shown. A throttle valve opening sensor 4 is connected to the main throttle valve for detecting its valve opening and converting same into an electrical signal which is supplied to an electronic control unit (hereinafter called "ECU") 5.

A fuel injection device 6 is arranged in the intake pipe 2 at a location between the engine 1 and the throttle body 3, which comprises main injectors and a subinjector, none of which is shown. The main injectors correspond in number to the engine cylinders and are each arranged in the main intake pipe at a location slightly upstream of an intake valve, not shown, of a corresponding engine cylinder, while the subinjector, which is single in number, is arranged in the sub intake pipe at a location slightly downstream of the sub throttle valve, for supplying fuel to all the engine cylinders. The main injectors and the subinjector are electrically connected to the ECU 5 in a manner having their valve opening periods or fuel injection quantities controlled by signals supplied from the ECU 5.

On the other hand, an absolute pressure sensor 8 communicates through a conduit 7 with the interior of the main intake pipe of the throttle body 3 at a location immediately downstream of the main throttle valve. The absolute pressure sensor 8 is adapted to detect absolute pressure in the intake pipe 2 and applies an electrical signal indicative of detected absolute pressure to the ECU 5. An intake-air temperature sensor 9 is arranged in the intake pipe 2 at a location downstream of the absolute pressure sensor 8 and also electrically connected to the ECU 5 for supplying thereto an electrical signal indicative of detected intake-air temperature.

An engine temperature sensor 10, which may be formed of a thermistor or the like, is mounted on the main body of the engine 1 in a manner embedded in the peripheral wall of an engine cylinder having its interior filled with cooling water, an electrical output signal of which is supplied to the ECU 5.

An engine rpm sensor (hereinafter called "Ne sensor") 11 and a cylinder-discriminating sensor 12 are arranged in facing relation to a camshaft, not shown, of the engine 1 or a crankshaft of same, not shown. The former 11 is adapted to generate one pulse at a particular crank angle each time the engine crankshaft rotates through 180 degrees, i.e., upon generation of each pulse of the top-dead-center position (TDC) signal, while the latter is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the main body of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of a detected concentration value to the ECU 5.

Further connected to the ECU 5 are a sensor 16 for detecting atomospheric pressure and a starter switch 17 for actuating the starter, not shown, of the engine 1, respectively, for supplying an electrical signal indicative of detected atmospheric pressure and an electrical signal indicative of its own on and off positions to the ECU 5.

Next, the fuel quantity control operation of the air/fuel ratio feedback control system of the invention arranged as above will now be described in detail with reference to FIG. 1 referred to hereinabove and FIGS. 2 through 15.

Figure 2:
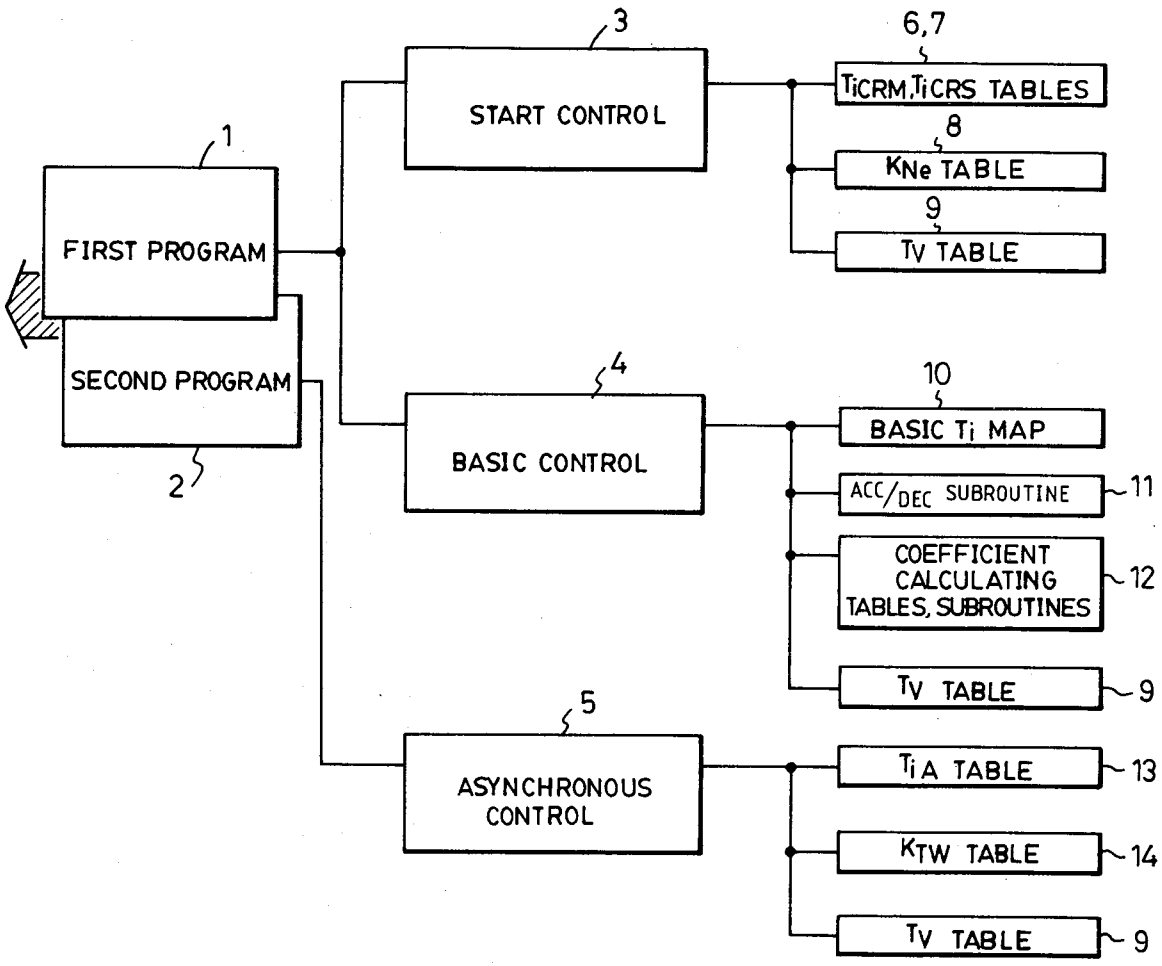
FIG. 2 is a block diagram illustrating a program for control of the valve opening periods TOUTM, TOUTS of the main injectors and the subinjector, which are operated by an electronic control unit (ECU) in FIG. 1.

Referring first to FIG. 2, there is illustrated a block diagram showing the whole program for air/fuel ratio control, i.e. control of valve opening periods TOUTM, TOUTS of the main injectors and the subinjector, which is executed by the ECU 5. The program comprises a first program 1 and a second program 2. The first program 1 is used for fuel quantity control in synchronism with the TDC signal, hereinafter merely called "synchronous control" unless otherwise specified, and comprises a start control subroutine 3 and a basic control subroutine 4, while the second program 2 comprises an asynchronous control subroutine 5 which is carried out in asynchronism with or independently of the TDC signal.

In the start control subroutine 3, the valve opening periods TOUTM and TOUTS are determined by the following basic equations:

$$TOUTM = TiCRM \times KNe + (TV + \Delta TV) \quad (1)$$

$$TOUTS = TiCRS \times KNe + TV \quad (2)$$

where TiCRM, TiCRS represent basic values of the valve opening periods for the main injectors and the subinjector, respectively, which are determined from a TiCRM table 6 and a TiCRS table 7, respectively, KNe represents a correction coefficient applicable at the start of the engine, which is variable as a function of engine rpm Ne and determined from a KNe table 8, and TV represents a constant for increasing and decreasing the valve opening period in response to changes in the output voltage of the battery, which is determined from a TV table 9. ΔTV is added to TV applicable to the main injectors as distinct from TV applicable to the subinjector, because the main injectors are structurally different from the subinjector and therefore have different operating characteristics.

The basic equations for determining the values of TOUTM and TOUTS applicable to the basic control subroutine 4 are as follows:

$$TOUTM = (TiM - TDEC) \times (KTA \times KTW \times KAFC \times KPA \times KAST \times KWOT \times KO_2 \times KLS) + TACC \times (KTA \times KTWT \times KAFC) + (TV + \Delta TV) \quad (3)$$

$$TOUTS = (TiS - TDEC) \times (KTA \times KTW \times KAST \times KPA) + TV \quad (4)$$

where TiM, Tis represent basic values of the valve opening periods for the main injectors and the subinjector, respectively, and are determined from a basic Ti map 10, and TDEC, TACC represent constants applicable, respectively, at engine decceleration and at engine acceleration and are determined by acceleration and decceleration subroutines 11. The coefficients KTA, KTW, etc. are determined by their respective tables and/or subroutines 12. KTA is an intake air temperature-dependent correction coefficient and is determined from a table as a function of actual intake air temperature, KTW a fuel increasing coefficient which is determined from a table as a function of actual engine cooling water temperature TW, KAFC a fuel increasing coefficient applicable after fuel cut operation and determined by a subroutine, KPA an atmospheric pressure-dependent correction coefficient determined from a table as a function of actual atmospheric pressure, and KAST a fuel increasing coefficient applicable after the start of the engine and determined by a subroutine. KWOT is a coefficient for enriching the air/fuel mixture, which is applicable at wide-open-throttle and has a constant value, $KO_2$ an "$O_2$ feedback control" correction coefficient determined by a subroutine as a function of actual oxygen concentration in the exhaust gases, and KLS a mixture-leaning coefficient applicable at "lean stoich." operation and having a constant value. The term "stoich." is an abbreviation of a word "stoichiometric" and means a stoichiometric or theoretical air/fuel ratio of the mixture. TACC is a fuel increasing constant applicable at engine acceleration and determined by a subroutine and from a table.

On the other hand, the valve opening period TMA for the main injectors which is applicable in asynchronism with the TDC signal is determined by the following equation:

$$TMA = TiA \times KTWT \times KAST + (TV + \Delta TV) \quad (5)$$

where TiA represents a TDC signal-asynchronous fuel increasing basic value applicable at engine acceleration and in asynchronism with the TDC signal. This TiA value is determined from a TiA table 13. KTWT is defined as a fuel increasing coefficient applicable at and after TDC signal-synchronous acceleration control as well as at TDC signal-asynchronous acceleration control, and is calculated from a value of the aforementioned water temperature-dependent fuel increasing coefficient KTW obtained from the table 14.

Figure 3:
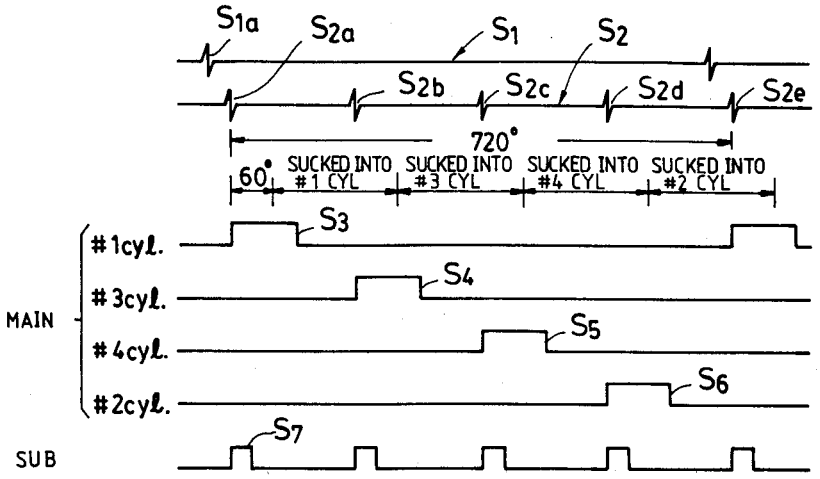
FIG. 3 is a timing chart showing the relationship between a cylinder-discriminating signal and a TDC signal inputted to the ECU, and drive shgnals for the main injectors and the subinjector, outputted from the ECU.

FIG. 3 is a timing chart showing the relationship between the cylinder-discriminating signal and the TDC signal, both inputted to the ECU 5, and the driving signals outputted from the ECU 5 for driving the main injectors and the subinjector. The cylinder-discriminating signal $S_1$ is inputted to the ECU 5 in the form of a pulse $S_1a$ each time the engine crankshaft rotates through 720 degrees. Pulses $S_2a$–$S_2e$ forming the TDC signal $S_2$ are each inputted to the ECU 5 each time the engine crankshaft rotates through 180 degrees. The relationship in timing between the two signals $S_1$, $S_2$ determines the output timing of driving signals $S_3$ –$S_6$ for driving the main injectors of the four engine cylinders. More specifically, the driving signal $S_3$ is outputted for driving the main injector of the first engine cylinder, concurrently with the first TDC signal pulse $S_2a$, the driving signal $S_4$ for the third engine cylinder concurrently with the second TDC signal pulse $S_2b$, the driving signal $S_5$ for the fourth cylinder concurrently with the third pulse $S_2c$, and the driving signal $S_6$ for the second cylinder concurrently with the fourth pulse $S_2d$, respectively. The subinjector driving signal $S_7$ is generated in the form of a pulse upon application of each pulse of the TDC signal to the ECU 5, that is, each time the crankshaft rotates through 180 degrees. It is so arranged that the pulses $S_2a$, $S_2b$, etc. of the TDC signal are each generated earlier by 60 degrees than the time when the piston in an associated engine cylinder reaches its top dead center, so as to compensate for arithmetic operation lag in the ECU 5, and a time lag between the formation of a mixture and the suction of the mixture into the engine cylinder, which depends upon the opening action of the intake pipe before the piston reaches its top dead center and the operation of the associated injector.

Figure 4:
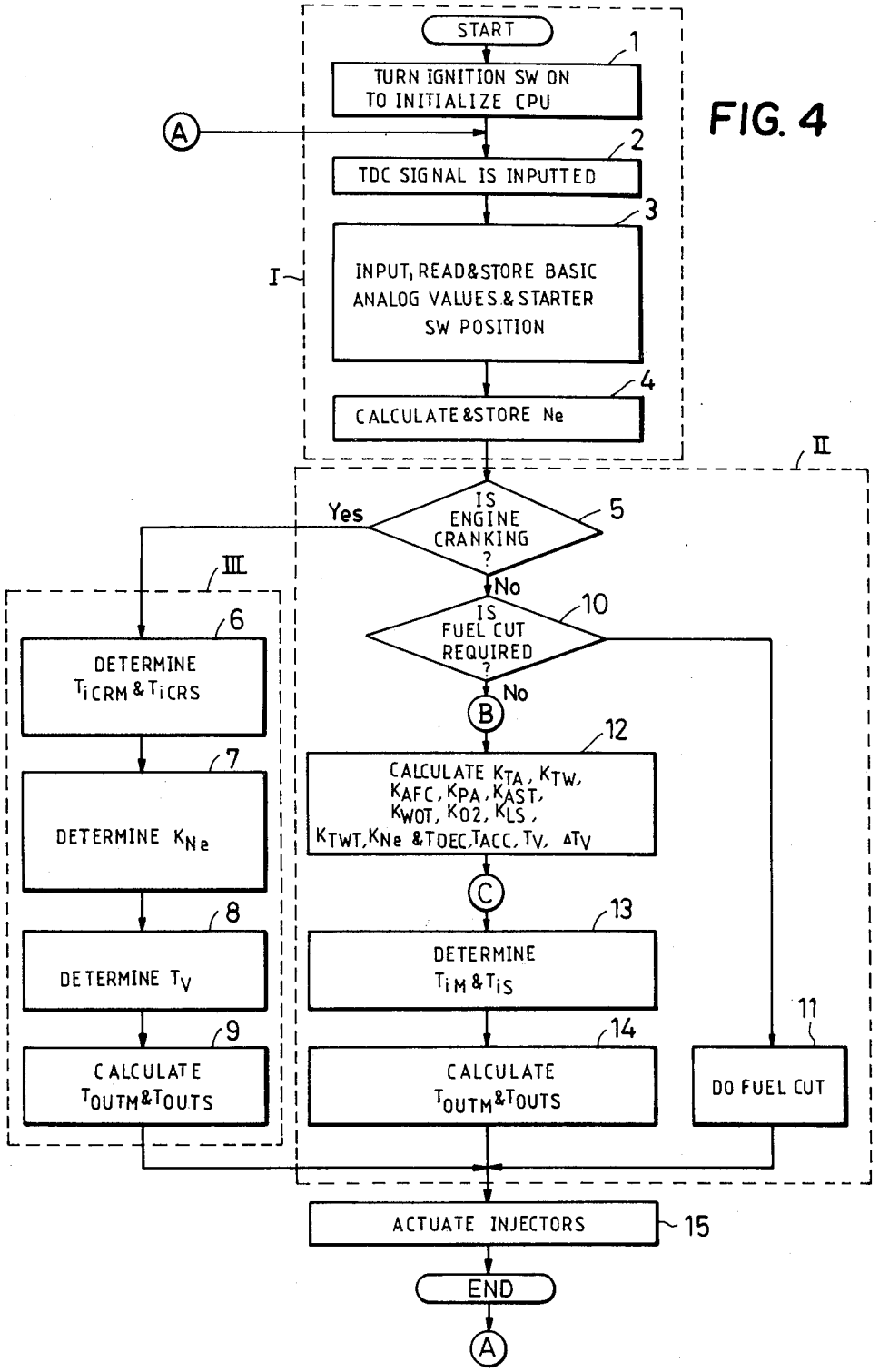
FIG. 4 is a flow chart showing a main program for control of the basic valve opening periods TOUTM, TOUTS.

Referring next to FIG. 4, there is shown a flow chart of the aforementioned first program 1 for control of the valve opening period in synchronism with the TDC signal in the ECU 5. The whole program comprises an input signal processing block I, a basic control block II and a start control block III. First in the input signal processing block I, when the ignition switch of the engine is turned on, CPU in the ECU 5 is initialized at the step 1 and the TDC signal is inputted to the ECU 5 as the engine starts at the step 2. Then, all basic analog values are inputted to the ECU 5, which include detected values of atmospheric pressure PA, absolute pressure PB, engine cooling water temperature TW, atmospheric air temperature TA, throttle valve opening $\theta$th, battery voltage V, output voltage value V of the $O_2$ sensor and on-off state of the starter switch 17, some necessary ones of which are then stored therein (step 3). Further, the period between a pulse of the TDC signal and the next pulse of same is counted to calculate actual engine rpm Ne on the basis of the counted value, and the calculated value is stored in the ECU 5 (step 4). The program then proceeds to the basic control block II. In this block, a determination is made, using the calculated Ne value, as to whether or not the engine rpm is smaller than the cranking rpm (starting rpm) at the step 5. If the answer is affirmative, the program proceeds to the start control subroutine III. In this block, values of TiCRM and TiCRS are selected from a TiCRM table and a TiCRS table, respectively, on the basis of the detected value of engine cooling water temperature TW (step 6). Also, the value of Ne-dependent correction coefficient KNe is determined by using the KNe table (step 7). Further, the value of battery voltage-dependent correction constant TV is determined by using the TV table (step 8). These determined values are applied to the aforementioned equations (1), (2) to calculate the values of TOUTM, TOUTS (step 9).

If the answer to the question of the above step 5 is no, it is determined whether or not the engine is in a condition for carrying out fuel cut, at the step 10. If the answer is yes, the values of TOUTM and TOUTS are both set to zero, at the step 11.

On the other hand, if the answer to the question of the step 10 is negative, calculations are carried out of values of correction coefficients KTA, KTW, KAFC, KPA, KAST, KWOT, $KO_2$, KLS, KTWT, etc. and values of correction constants TDEC, TACC, TV, and $\Delta$TV, by means of the respective calculation subroutines and tables, at the step 12.

Then, basic valve opening period values TiM and TiS are selected from respective maps of the TiM value and the TiS value, which correspond to data of actual engine rpm Ne and actual absolute pressure PB and/or like parameters, at the step 13.

Then, calculations are carried out of the values TOUTM, TOUTS on the basis of the values of correction coefficients and correction constants selected at the steps 12 and 13, as described above, using the aforementioned equations (3), (4) (the step 14). The main injectors and the subinjector are actuated with valve opening periods corresponding to the values of TOUTM, TOUTS obtained by the aforementioned steps 9, 11 and 14 (the step 15).

As previously stated, in addition to the above-described control of the valve opening periods of the main injectors and the subinjector in synchronism with the TDC signal, asynchronous control of the valve opening periods of the main injectors is carried out in a manner asynchronous with the TDC signal but synchronous with a certain pulse signal having a constant pulse repetition period, detailed description of which is omitted here.

Figures 5, 5B:
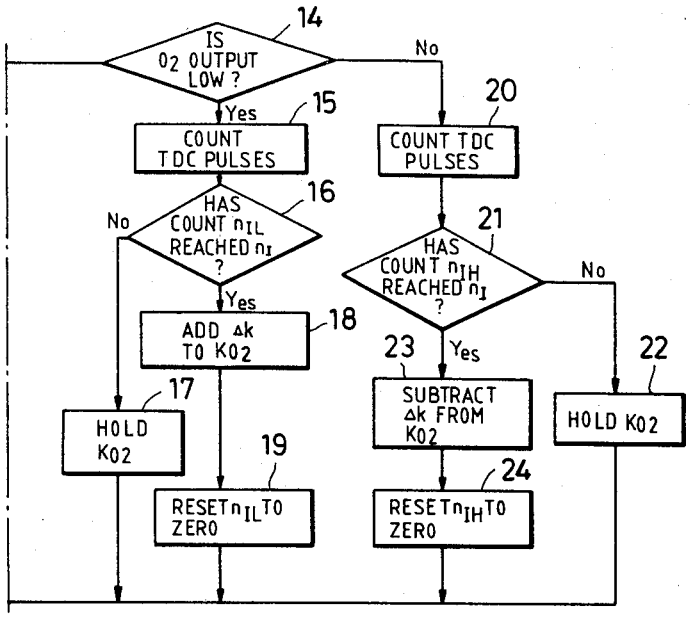
FIGS. 5A and 5B illustrate a flow chart showing a subroutine for calculation of the value of "$O_2$-feedback control" correction coefficient $KO_2$.
Figure 5A:
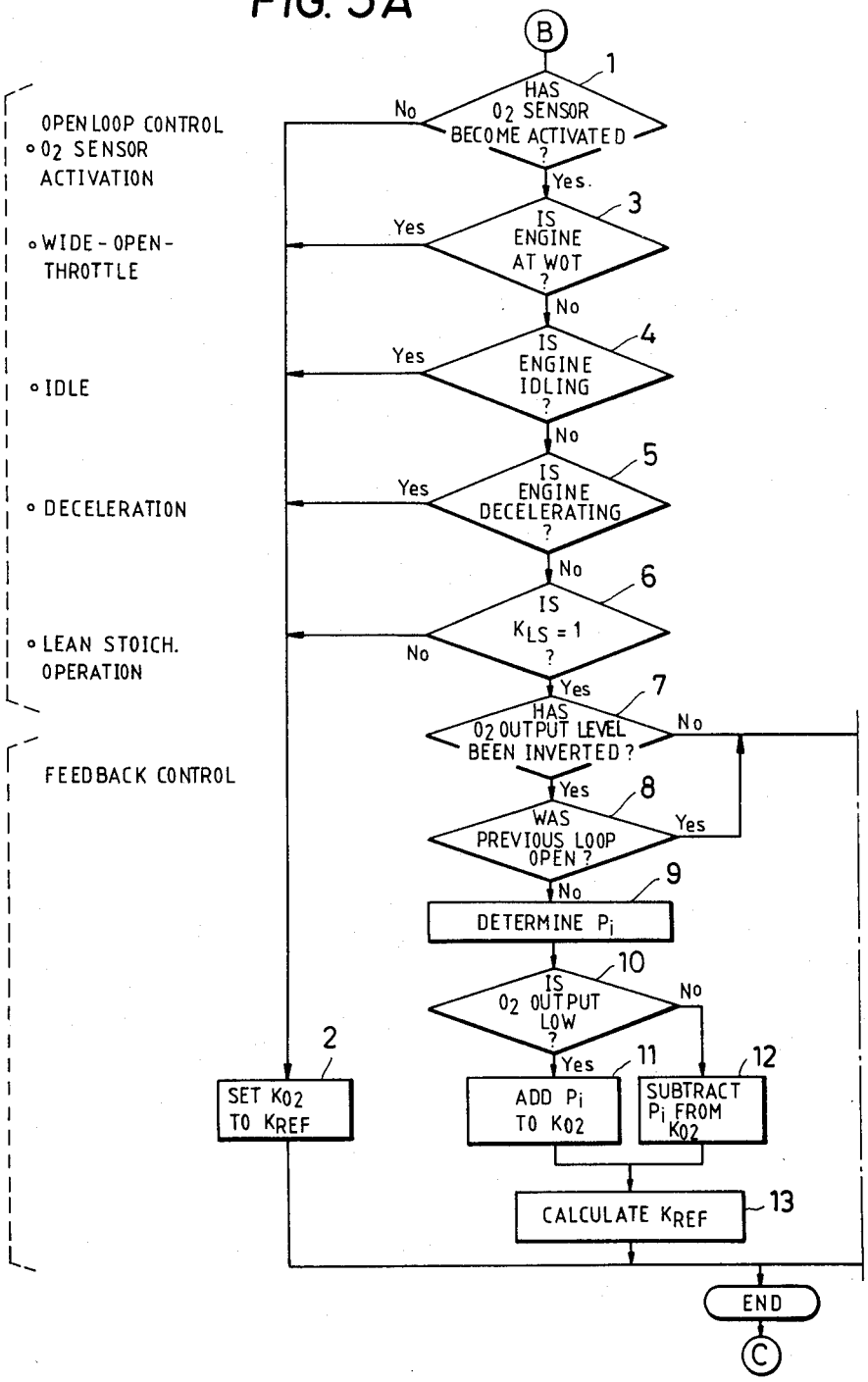

The subroutine for calculating the value of "$O_2$ feedback control" correction coefficient $KO_2$ will now be described with reference to FIG. 5 showing a flow chart of the same subroutine.

First, a determination is made as to whether or not the $O_2$ sensor has become activated, at the step 1. More specifically, by utilizing the internal resistance of the $O_2$ sensor, it is detected whether or not the output voltage of the $O_2$ sensor has dropped to an initial activation point VX (e.g. 0.6 volt). Upon the point VX being reached, an activation-indicative signal is generated which actuates an associated activation delay timer to start counting a predetermined period of time (e.g. 60 seconds). At the same time, it is determined whether or not both the water temperature-dependent fuel increasing coefficient KTW and the after-start fuel increasing coefficient KAST are equal to 1. If all the above conditions are found to be fulfilled, it is then determined that the $O_2$ sensor has been activated. If the activation of the $O_2$ sensor is negated at the step 1, the value of correction coefficient $KO_2$ is set to a mean value KREF, referred to later, which has been obtained in the last feedback control operation based on the $O_2$ sensor output, at the step 2. When the $O_2$ sensor is found to be activated, a determination is made as to whether or not the throttle valve is fully opened (wide-open-throttle), at the step 3. If the answer is yes, the value of $KO_2$ is also set to the above mean value KREF at the step 2. If the throttle valve is not fully opened, whether or not the engine is at idle is determined at the step 4. To be concrete, if the engine rpm Ne is smaller than a predetermined value NLDL (e.g. 1000 rpm) and the absolute pressure PB is lower than a predetermined value PBIDL (e.g. 360 mmHg), the engine is judged to be idling, and then the above step 2 is executed to set the $KO_2$ value to the value KREF. If the engine is not found to be idling, whether or not the engine is decelerating is determined at the step 5. To be concrete, it is judged that the engine is decelerating, when the absolute pressure PB is lower than a predetermined value PBDEC (e.g. 200 mmHg), and then the value of $KO_2$ is held at the above value KREF, at the step 2. On the other hand, if it is determined that the engine is not decelerating, whether or not the mixture leaning coefficient KLS applicable at lean stoich. operation then has a value of 1 is determined at the step 6. If the answer is no, the $KO_2$ value is also held at the above value KREF at the step 2, while if the answer is yes, the program proceeds to the closed loop control which will be described below.

Figure 6:
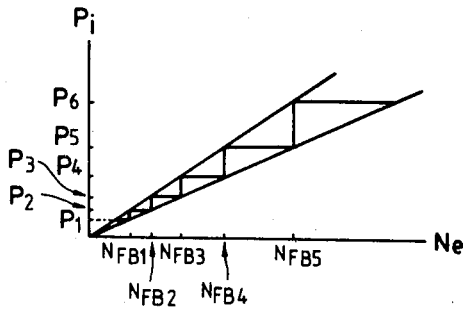
FIG. 6 is a view showing an Ne-Pi table for determining a correction value Pi for correcting "$O_2$-feedback control" correction coefficient $KO_2$.

In the closed loop control, it is first determined whether or not there has occurred an inversion in the output level of the $O_2$ sensor, at the step 7. If the answer is affirmative, whether or not the previous loop was an open loop is determined at the step 8. If it has been determined that the previous loop was not an open loop, the air/fuel ratio of the mixture is controlled by proportional term control (P-term control). More specifically, referring to FIG. 6 showing an Ne-Pi table for determining a correction amount Pi by which the coefficient $KO_2$ is corrected, five different predetermined Ne values NFB1–5 are provided which has values falling within a range from 1500 rpm to 3500 rpm, while five different predetermined Pi values P1–6 are provided in relation to the above Ne values, by way of example. Thus, the value of correction amount Pi is determined from the engine rpm Ne at the step 9, which is added to or subtracted from the coefficient $KO_2$ upon each inversion of the output level of the $O_2$ sensor. Then, whether or not the output level of the $O_2$ sensor is low is determined at the step 10. If the answer is yes, the Pi value obtained from the table of FIG. 6 is added to the coefficient $KO_2$, at the step 11, while if the answer is no, the former is subtracted from the latter at the step 12. Then, a mean value KREF is calculated from the value of $KO_2$ thus obtained, at the step 13. Calculation of the mean value KREF can be made by the use of the following equation:

$$KREF = \frac{CREF}{A} \times KO_{2p} + \frac{A - CREF}{A} \times KREF \quad (6)$$

where $KO_2p$ represents a value of $KO_2$ obtained immediately before or immediately after a proportional term (P-term) control action, A a constant (e.g. 256), CREF a variable which is set within a range from 1 to A, and KREF' a mean value of values $KO_2$ obtained from the start of the first operation of an associated control circuit to the last proportional term control action inclusive.

Since the value of the variable CREF determines the ration of the value $KO_2p$ obtained at each P-term control action, to the value KREF, an optimum value KREF can be obtained by setting the value CREF to a suitable value within the range from 1 to A depending upon the specifications of an air/fuel ratio control system, an engine, etc. to which the invention is applied.

Figure 7:
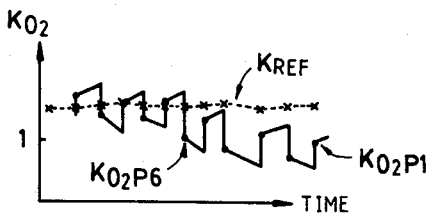
FIG. 7 is a graph showing a manner of detecting the value of correction coefficient $KO_2$ by means of proportional term control.

As noted above, the value KREF is calculated on the basis of a value $KO_2p$ obtained immediately before or immediately after each P-term control action. This is because an air/fuel ratio of the mixture being supplied to the engine occurring immediately before or immediately after a P-term control action, that is, at an instant of inversion of the output level of the $O_2$ sensor shows a value most close to the theoretical mixture ratio (14.7). Thus, a mean value of $KO_2$ values can be obtained which are each calculated at an instant when the actual air/fuel ratio of the mixture shows a value most close to the theoretical mixture ratio, thus making it possible to calculate a value KREF most appropriate to the actual operating condition of the engine. FIG. 7 is a graph showing a manner of detecting (calculating) the value $KO_2p$ at an instant immediately after each P-term control action. In FIG. 7, the mark · indicates a value $KO_2p$ detected immediately after a P-term control action, and $KO_2p1$ is an up-to-date value detected at the present time, while $KO_2p6$ is a value detected immediately after a P-term control action which is a sixth action from the present time.

The mean value KREF can also be calculated from the following equation, in place of the aforementioned equation (6):

$$KREF = \frac{1}{B} \sum_{j=1}^{B} KO_{2pj} \quad (7)$$

where $KO_2pj$ represents a value of $KO_2p$ obtained immediately before or immediately after a first one of a j-number of P-term control actions which take place before the present one, and B a constant which is equal to a predetermined number of P-term control actions (a predetermined number of inversions of the $O_2$ sensor output) subjected to calculation of the mean value. The larger the value of B, the larger the ratio of each value $KO_2p$ to the value KREF. The value of B is set at a suitable value depending upon the specifications of an air/fuel ratio feedback control system, an engine, etc. to which the invention is applied. According to the equation (7), calculation is made of the sum of the values of $KO_2pj$ from the P-term control action taking place B times before the present P-term control action to the present P-term control action, each time a value of $KO_2pj$ is obtained, and the mean value of these values of $KO_2pj$ forming the sum is calculated.

Further, according to the above equations (6) and (7), the mean value KREF is renewed each time a new value of $KO_2p$ is obtained during feedback control based upon the $O_2$ sensor output, by applying the above new value of $KO_2p$ to the equations. Thus, the value KREF obtained always fully represents the actual operating condition of the engine.

Figure 8:
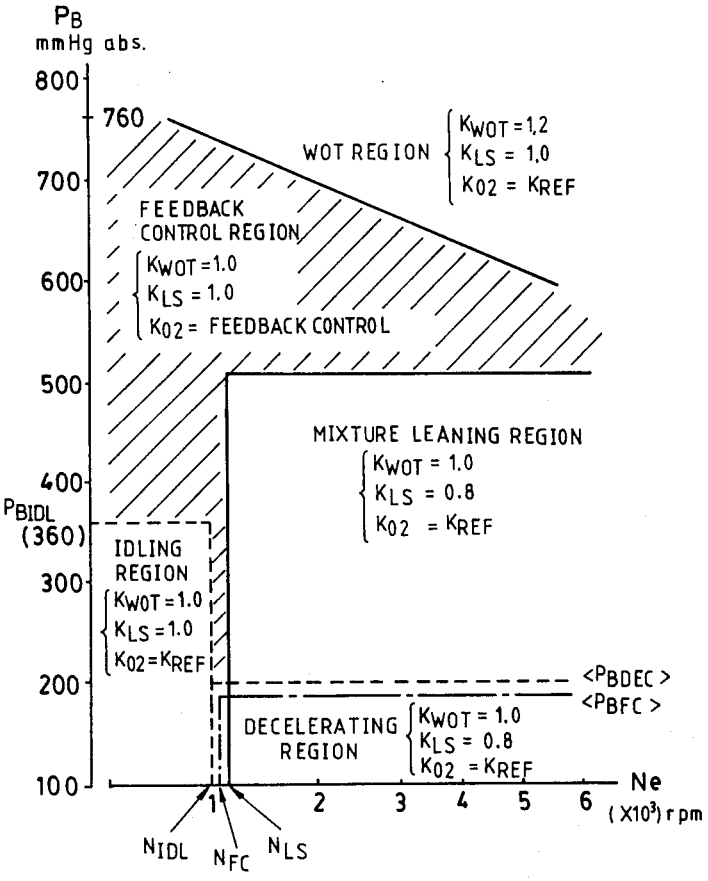
FIG. 8 is a graph showing a manner of applying correction coefficients to various operating conditions of the engine.

The mean value KREF calculated as described above is used for control of the air/fuel ratio of the mixture together with the other correction coefficients, that is, the wide-open-throttle correction coefficient KWOT and the mixture-leaning operation correction coefficient KLS, during an open loop control operation immediately following the feedback control operation based upon the $O_2$ sensor output in which the same value KREF has been calculated. The open loop control operation is carried out in particular engine operating regions such as an engine idle region, a mixture leaning region, a wide-open-throttle operating region, and a decelerating region. More specifically, as shown in FIG. 8, in the wide-open-throttle operating region, the value of $KO_2$ is set to the mean value KREF obtained in the $O_2$ sensor output-based feedback control operation carried out immediately before the present time, and simultaneously the value of the wide-open-throttle coefficient KWOT is set to a predetermined value of 1.2, and the value of the mixture-leaning coefficient KLS a value of 1.0, respectively. In the mixture leaning region and the decelerating region, the value of $KO_2$ is set to the above mean value KREF, the coefficient KLS a predetermined value of 0.8, and the coefficient KWOT a value of 1.0, respectively. In the idling region, the value of $KO_2$ is set to the above value KREF, and the coefficients KLS, KWOT are both set to 1.0.

Reverting now to FIG. 5, if the answer to the question of the step 7 is no, that is, if the $O_2$ sensor output level remains at the same level, or if the answer to the question of the step 8 is yes, that is, if the previous loop was an open loop, the air/fuel ratio of the mixture is controlled by integral term control (I-term control). More specifically, whether or not the $O_2$ sensor output level is low is determined at the step 14. If the answer is yes, TDC signal pulses are counted at the step 15, accompanied by determining whether or not the count nIL has reached a predetermined value nI (e.g. 30 pulses), at the step 16. If the predetermined value nI has not yet been reached, the $KO_2$ value is held at its immediately preceding value, at the step 17. If the value nIL is found to have reached the value nI, a predetermined value $\Delta k$ (e.g. about 0.3% of the $KO_2$ value) is added to the $KO_2$ value, at the step 18. At the same time, the number of pulses nIL so far counted is resetted to zero at the step 19. After this, the predetermined value $\Delta k$ is added to the $KO_2$ value each time the value nIL reaches the value nI. On the other hand, if the answer to the question of the step 14 is found to be no, TDC pulses are counted at the step 20, accompanied by determining whether or not the count nIH has reached the predetermined value nI at the step 21. If the answer is no at the step 21, the $KO_2$ value is held at its immediately preceding value, at the step 22, while if the answer is yes, the predetermined value $\Delta k$ is subtracted from the $KO_2$ value, at the step 23, and simultaneously the number of pulses nIH so far counted is resetted to zero at the step 24. Then, the predetermined value $\Delta k$ is subtracted from the $KO_2$ value each time the value nIH reaches the value nI in the same manner as mentioned above.

FIGS. 9 through 12 are circuit diagrams illustrating the internal arrangement of the ECU 5 used in the air/fuel ratio feedback control system of the invention described above, in which the calculating section for the correction coefficients $KO_2$ and KREF is shown in particular detail.

Figures 9, 9B:
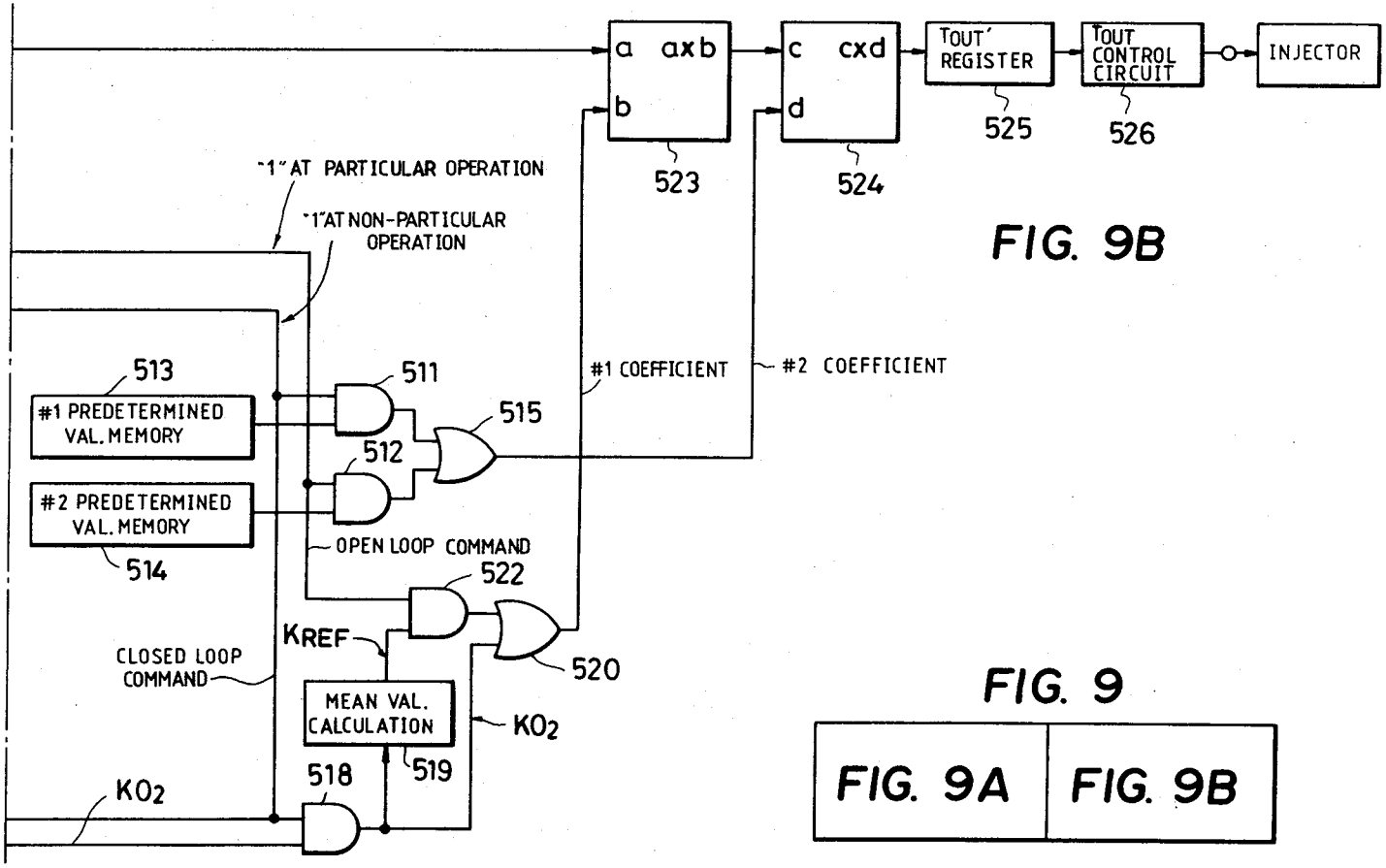
FIGS. 9A and 9B illustrate a circuit diagram illustrating the whole internal arrangement of the ECU, showing in detail a correction coefficient $KO_2$ calculating section.
Figure 9A:
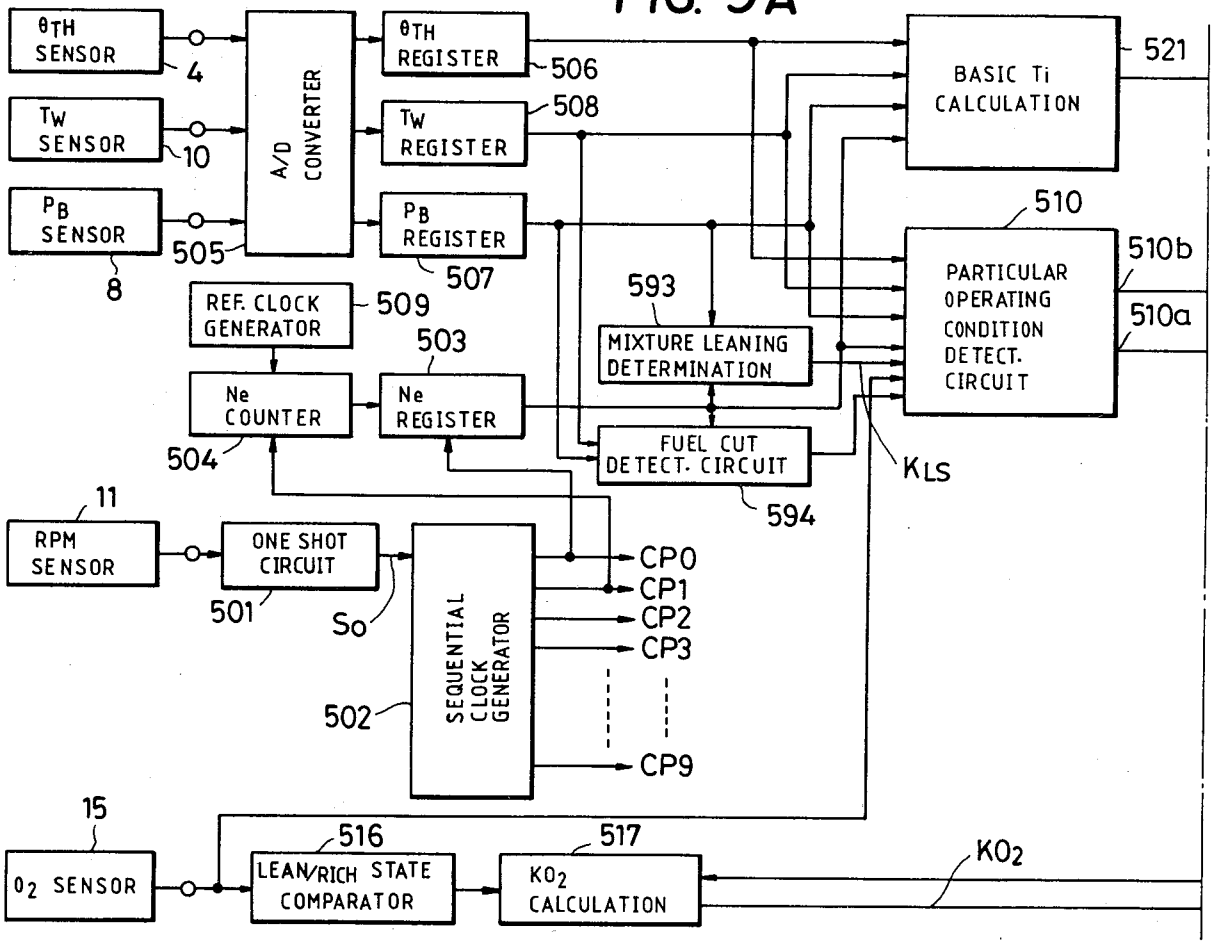

Referring first to FIG. 9, the whole internal arrangement of the ECU 5 is shown, which incorporates the calculating section for the correction coefficients $KO_2$ and KREF. The TDC signal picked up by the engine rpm (Ne) sensor 11 appearing in FIG. 1 is applied to a one shot circuit 501 which forms a waveform shaper circuit in cooperation with a sequential clock generator circuit 502 arranged adjacent thereto. The one shot circuit 501 generates an output signal So upon application of each TDC signal pulse thereto, which signal actuates the sequential clock generator circuit 502 to generate clock pulses CP0–9 in a sequential manner. The clock pulse CP0 is supplied to an engine rpm (Ne) register 503 to cause same to store an immediately preceding count outputted from an engine rpm (Ne) counter 504 which counts reference clock pulses generated by a reference clock generator 509. The clock pulse CP1 is applied to the engine rpm counter 504 to reset the immediately preceding count in the counter 504 to zero. Therefore, the engine rpm Ne is measured in the form of the number of reference clock pulses counted between two adjacent pulses of the TDC signal, and the counted reference clock pulse number or measured engine rpm Ne is stored into the above engine rpm register 503. Further, the clock pulses CP0–9 are supplied to various circuits appearing in FIGS. 11 and 12, hereinlater referred to.

In a manner parallel with the above operation, output signals of the throttle valve opening ($\theta$th) counter 4, the absolute pressure (PB) sensor 8 and the engine water temperature (TW) sensor 10 are supplied to an A/D converter unit 505 to be converted into respective digital signals which are in turn applied to a throttle valve opening ($\theta$th) register 506, an absolute pressure (PB) register 507, and an engine water temperature (TW) register 508, respectively. The values stored in the above registers and the value stored in the engine rpm register 503 are supplied to a basic Ti calculating circuit 521 and a particular operating condition detecting circuit 510. The values stored in the absolute pressure register 507 and the engine rpm register 503 are also supplied to a mixture leaning operation-determining circuit 593 which in turn is responsive to these input values to supply a signal indicative of the value of correction coefficient KLS to the particular operating condition detecting circuit 510 during mixture leaning operation. Further, the values stored in the engine rpm register 503, the absolute pressure register 507 and the engine water temperature register 508 are also supplied to a fuel cut detecting circuit 594 which in turn is responsive to these input values to supply the particular operating condition detecting circuit 510 with a binary signal indicative of whether or not the engine is in a fuel-cut condition. The basic Ti calculating circuit 521 is responsive to the values inputted from the above registers 503, and 506–508 to carry out calculations of the values of the coefficients for determination of the basic fuel injection period Ti. The particular operating condition detecting circuit 510 is also supplied with an output signal from the $O_2$ sensor 15 in FIG. 1 and responsive to the value of the same output signal to determine whether or not the activation of the $O_2$ sensor 15 has completed. After determining the completion of the activation of the $O_2$ sensor 15, the circuit 510 further determines whether or not the engine is operating in a particular operating region (for instance, wide-open-throttle operating region, idling region, decelerating region, or mixture leaning region). Upon fulfillment of one of the above particular operating conditions, the circuit 510 generates a binary output of 1 as an open loop command signal at its output terminal **510*b*. When none of the above particular operating conditions is fulfilled, that is, when the engine is operated in an air/fuel ratio feedback control mode in response to the $O_2$ sensor output, the circuit 510 generates a binary output of 1 as a closed loop command signal at its output terminal 510*a*. The former output of 1 generated at the output terminal 510*b* is supplied to one input terminal of an AND circuit 512, and the latter output of 1 at the output terminal 510*a* one input terminal of an AND circuit 511, respectively. The AND circuits 511 and 512 have their other input terminals supplied, respectively, with values stored in a first predetermined value memory 513 and a second predetermined value memory 514. The first predetermined value memory 513 stores coefficient values (e.g. a KWOT value of 1.0 and a KLS value of 1.0) applicable when none of the particular operating conditions is fulfilled, that is, during "$O_2$ feedback control" operation, and the second predetermined value memory 514 stores coefficient values (e.g. a KWOT value of 1.2 and a KLS value of 1.0 for wide-open-throttle operating region, a KWOT value of 1.0 and a KLS value of 0.8 for mixture leaning region, a KWOT of 1.0 and a KLS value of 0.8 for decelerating region, and a KWOT value of 1.0 and a KLS value of 1.0 for idling region) applicable when one of the particular operating conditions is fulfilled, that is, during open loop control operation. As long as the AND circuits 511 and 512 are supplied at their above one input terminals with the outputs of 1 from the particular operating condition detecting circuit 510, they allow the values stored in the memories 513 and 514 to be supplied as second coefficients to a multiplier 524, hereinlater referred to, through an OR circuit 515**.

On the other hand, the output signal of the $O_2$ sensor 15 in FIG. 1 is inputted to a lean/rich state comparator 516 in FIG. 9, which in turn determines whether or not the output level of the $O_2$ sensor 15 is low or high. The resultant lean/rich state-discriminating signal is applied to an $KO_2$ calculating circuit 517 which is also supplied with the closed loop command signal from the output terminal **510*a* of the particular operating condition detecting circuit 510. The $KO_2$ calculating circuit 517 is responsive to the above lean/rich state-discriminating signal to calculate the value of $KO_2$, as described in detail later, and the resultant calculated value $KO_2$ is applied to one input terminal of an AND circuit 518. The AND circuit 518 is arranged to be supplied at its other input terminal with the closed loop command signal of 1 from the particular operating condition detecting circuit 510 through its output terminal 510***a*. Thus, during the $O_2$ feedback control when no particular operating condition is fulfilled, the AND circuit 518 allows the calculated $KO_2$ value signal supplied from the $KO_2$ calculating circuit 517 to be applied as a first coefficient b to one input terminal of a first multiplier 523 through an OR circuit 520. The first multiplier 523 has its other input terminal supplied with a basic value signal as input a from the basic Ti calculating circuit 521 to multiply this Ti value a by the above calculated $KO_2$ value b, and the resultant product signal $a \times b$ or $Ti \times KO_2$ is applied as input c to one input terminal of a second multiplier 524. This second multiplier 524 has its other input terminal supplied with the values of coefficients KWOT, KLS applicable during closed loop control (both having a value of 1.0) as input d, to multiply the above product $a \times b$ equalling $Ti \times KO_2$ by the values of coefficients KWOT, KLS to obtain a basic value TOUT' (which is substantially equal to the output product of the first multiplier 523). This basic value TOUT' is applied to a TOUT value control circuit 526 through a TOUT' value register 525. The TOUT value control circuit 526 performs an arithmetic operation using the aforementioned basic equation by adding to and/or multiplying the value TOUT' by the aforementioned other correction coefficients and constants, results of which are supplied to the main injectors as driving outputs.

During the above-described $O_2$ feedback control operation, the output of the AND circuit 518 is also supplied to a mean value calculating circuit 519 which in turn calculates a mean value KREF from $KO_2$ values successively inputted thereto during the $O_2$ feedback control operation, the resultant mean value KREF is applied to one input terminal of an AND circuit 522.

When one of the particular operating conditions of the engine is detected by the detecting circuit 510, the AND circuit 522 has its other input terminal supplied with the open loop command signal of 1 from the circuit 510 so that the calculated mean value KREF supplied from the mean value calculating circuit 519 is applied to the first multiplier 523 as the first coefficient. The first multiplier 523 calculates a product of a basic value Ti and this calculated mean value KREF to apply the resultant signal to the second multiplier 524, in the same manner as previously described. During the open loop control operation, the second multiplier 524 is supplied with the values of coefficients KWOT, KLS as the second coefficients from the second predetermined value memory 514, through the AND circuit 512 and the OR circuit 515, to multiply a product value supplied from the first multiplier 523 by the values of these second coefficients. The resultant product signal is supplied to the TOUT value control circuit 526 through the TOUT' value register 525, and then the TOUT value control circuit 526 performs a valve opening period control operation similar to that performed during the closed loop control operation as previously described.

Figure 10:
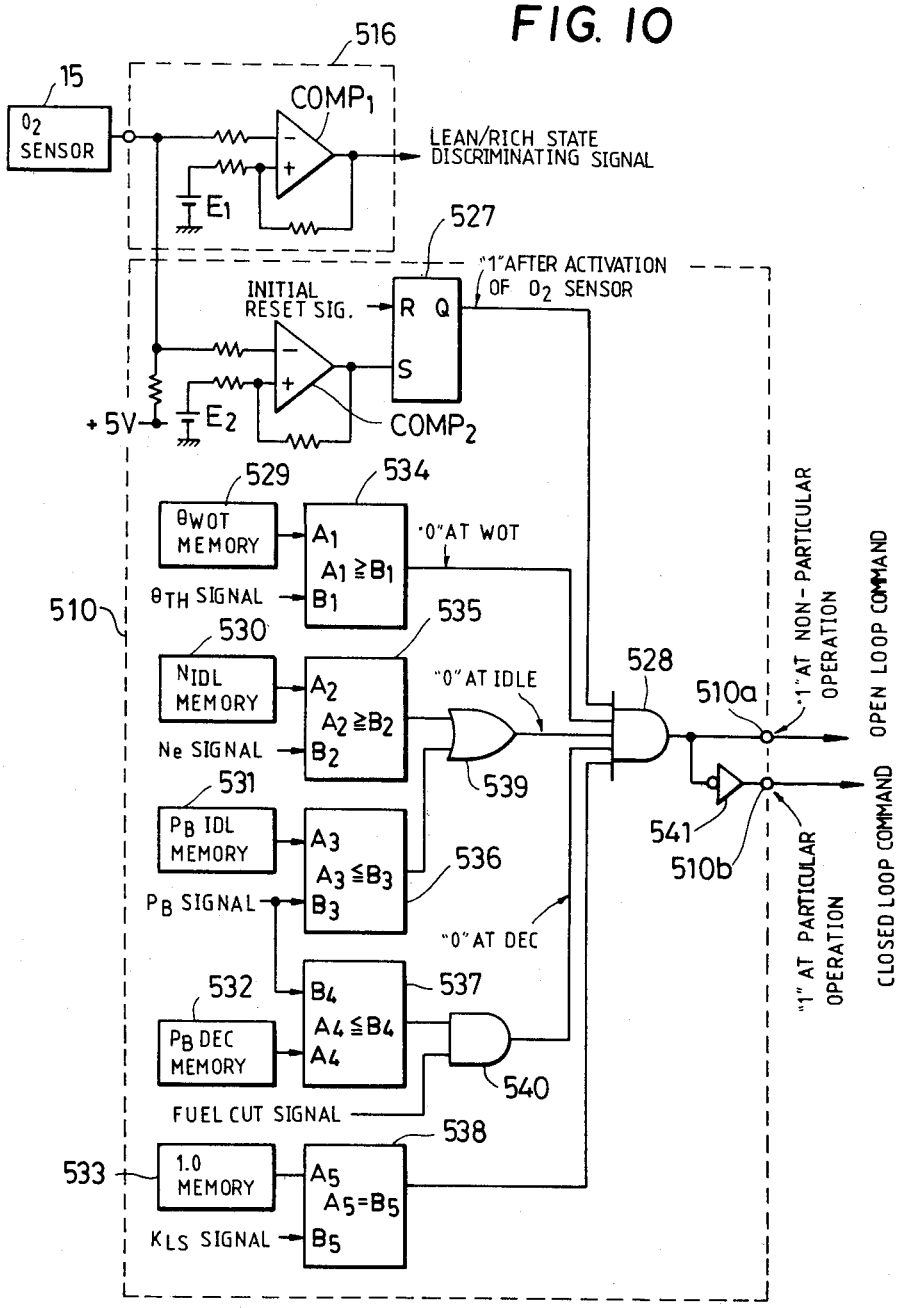
FIG. 10 is a circuit diagram illustrating details of a lean/rich state comparator and part of a particular operating condition detecting circuit in FIG. 9.

FIG. 10 illustrates the internal arrangements of the particular operating condition detecting circuit 510 and the lean/rich state comparator 516, both appearing in FIG. 9. The lean/rich state comparator 516 comprises a comparator $COMP_1$ formed of an operational amplifier which is arranged to be supplied at its inverting input terminal with the output of the $O_2$ sensor 15 and at its non-inverting input terminal with a predetermined reference voltage level $E_1$, respectively. The comparator $COMP_1$ generates a high level output of 1 when the output voltage level of the $O_2$ sensor 15 is lower than the reference voltage level $E_1$, that is, the mixture is in a lean state, while it generates a low level output of 0 when the former is higher than the latter, or the mixture is in a rich state. The output of the comparator $COMP_1$ is supplied to the $KO_2$ calculating circuit 517 in FIG. 9. The output of the $O_2$ sensor 15 is also supplied to another comparator $COMP_2$ which forms part of the $O_2$ sensor activation determining section of the particular operating condition detecting circuit 510. The comparator $COMP_2$ also comprises an operational amplifier having its inverting input terminal supplied with the output of the $O_2$ sensor and its non-inverting input terminal with a predetermined reference voltage level $E_2$ (e.g. 0.6 volt), respectively. As generally known, the $O_2$ sensor 15 has the output characteristic that as its activation proceeds, its output voltage level drops due to a reduction in its internal resistance. When the output voltage level of the $O_2$ sensor 15 drops below the above predetermined reference voltage level $E_2$, the comparator $COMP_2$ generates a high level output of 1 and applies it to the set pulse input terminal of an RS flip flop 527. The RS flip flop 527 has its reset pulse input terminal R supplied with an initial reset signal at the start of the engine to generate an output of 0 at its Q-output terminal. When supplied with the above output of 1 from the comparator $COMP_2$, the flip flop 527 generates an output of 1 at its Q-output terminal and applies it to one input terminal of an AND circuit 528 as an activation-indicative signal.

The particular operating condition detecting circuit 510 further includes a plurality of memories storing respective predetermined values for determination of various particular operating conditions of the engine, that is, a $\theta$WOT value memory 529, an NIDL value memory 530, a PBIDL value memory 531, a PBDEC value memory 532 and a 1.0 value memory 533, which are provided for determining the wide-open-throttle operating region, the idling region, the decelerating region and the mixture leaning region, respectively, and are connected, respectively, to comparators 534–538. The comparators 534–538 are each adapted to generate an output of 1 when its corresponding particular operating condition is not fulfilled, as described below.

First, the comparator 534 generates an output of 1 when a predetermined $\theta$WOT value (e.g. 50 degrees) supplies from the memory 529 is higher than or equal to the value of the actual throttle valve opening $\theta$, that is, the input relationship $A_1 \geqq B_1$ shown in the figure stands. This output of 1 is applied to the AND circuit 528. The comparator 535 generates an output of 1 when a predetermined engine rpm value (e.g. 1000 rpm) is lower than or equal to the value of the actual engine rpm Ne, that is, the input relationship of $A_2 \geqq B_2$ stands, the input $A_2$ corresponding to the above predetermined rpm and the input $B_2$ being a number of reference clock pulses counted between two adjacent pulses of the TDC signal. The NIDL value memory 530 stores a reciprocal of the predetermined value NIDL for the convenience of comparison with the actual engine rpm Ne which is read into the engine rpm register 503 in FIG. 9 in the form of a number of reference clock pulses counted between two adjacent TDC pulses. The comparator 536 generates an output of 1 when a predetermined absolute pressure value PBIDL (e.g. 360 mmHg) supplied from the PBIDL value memory 531 is lower than or equal to the value of the actual absolute pressure PB, or the input relationship of $A_3 \leqq B_3$ stands. When either the comparator 535 or the comparator 536 generates an output of 1, this output is supplied to the AND circuit 528 through an OR circuit 539.

The comparator 536 generates an output of 1 when a predetermined absolute pressure value PBDEC supplied from the PBDEC value memory 532 is lower than or equal to the value of the actual absolute pressure PB, that is, the input relationship of $A_4 \leqq B_4$ stands. This output of 1 is applied to one input terminal of an AND circuit 540. The AND circuit 540 generates an output of 1 and applies it to the AND circuit 528 when supplied with both the above output of 1 from the comparator 537 and a binary signal of 1 supplied from the fuel cut detecting circuit 594 in FIG. 9 when the fuel cut condition is not fulfilled. Lastly, the comparator 538 generates an output of 1 when the actual value of the correction coefficient KLS has a value of 1.0, that is, the input relationship of $A_5 = B_5$ stands, and applies the above output of 1 to the AND circuit 528. When supplied with the aforementioned $O_2$ sensor activation-indicative signal of 1 and all of the outputs of 1 from the comparators 534–538, the AND circuit 528 generates an output of 1, which is outputted from the output terminal 510*a* of the particular operating condition detecting circuit 510 as the closed loop command signal. On the other hand, when not supplied with the above $O_2$ sensor activation-indicative signal of 1 or supplied with outputs of the comparators 534–536, some of which have a value of 0, of course the AND circuit 528 generates an output of 0 which is then inverted into a high level of 1 by an inverter 541 connected to the output of the AND circuit 528, and outputted through the output terminal 510*b* of the circuit 510 as the open loop command signal.

Figure 11:
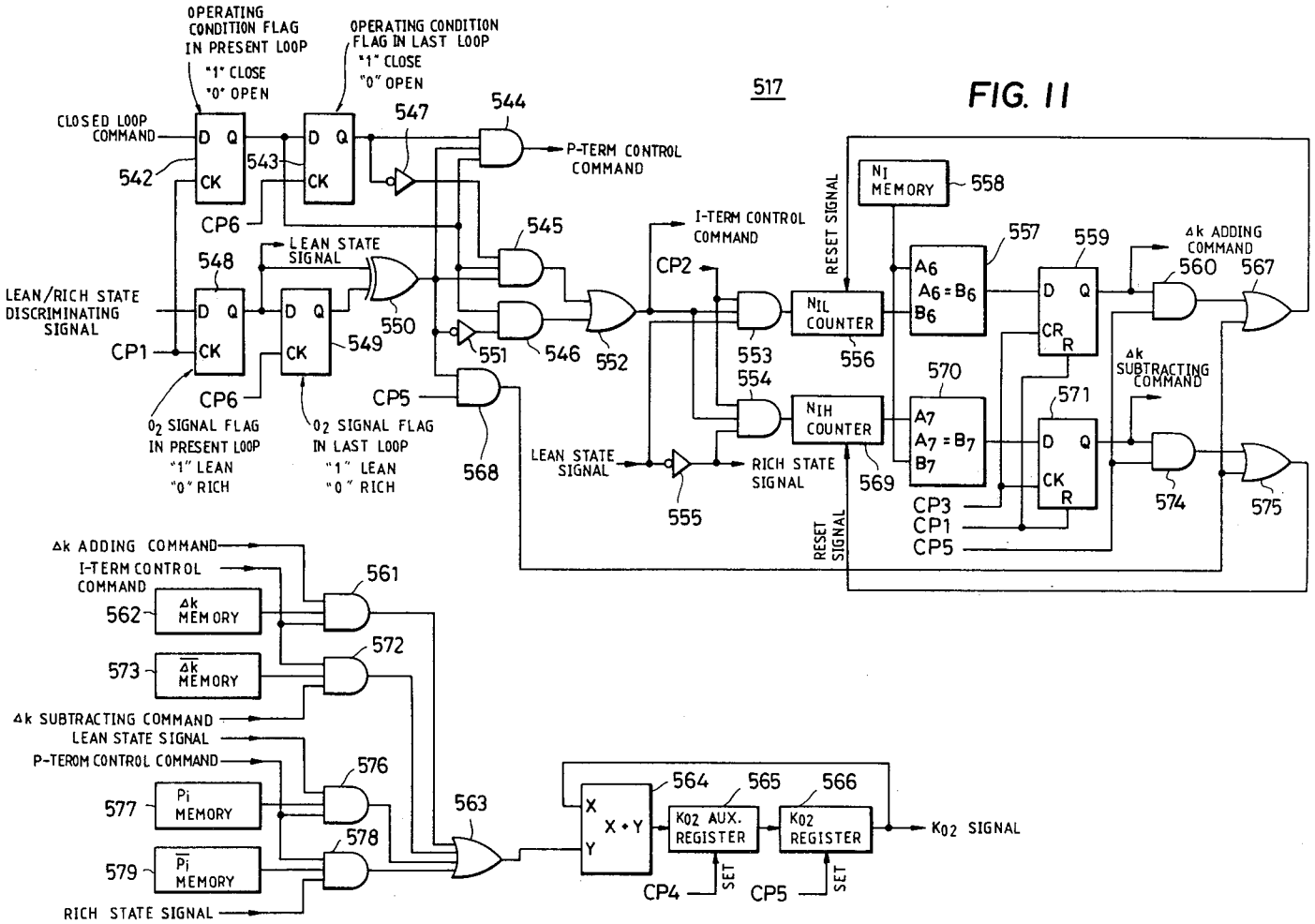
FIG. 11 is a circuit diagram illustrating details of a $KO_2$ calculating circuit in FIG. 9.

FIG. 11 illustrates the internal arrangement of the $KO_2$ calculating circuit 517 in FIG. 9. In the FIG. 11 arrangement, the closed loop command signal of 1 outputted from the particular operating condition detecting circuit 510 is applied to the D-input terminal of a first D flip flop 542. This D flip flop 542 is provided to generate a flag signal indicative of the engine operating condition occurring in the present loop, which has a value of 1 when the control is carried out in closed loop mode, and a value of 0 when it is carried out in open loop mode. More specifically, after supplied with the closed loop command signal of 1, the D flip flop 542 generates an output of 1 at its Q-output terminal upon application of a clock pulse CP1 generated from the sequential clock generator 502, and applies it to AND circuits 544, 545 and 546. Connected to the first D flip flop 542 is a second D flip flop 543 which is arranged to generate a flag signal indicative of the engine operating condition occurring in the last or immediately preceding loop. That is, the D flip flop 543 generates an output of 1 at its Q-output terminal if the last loop was in closed mode, and an output of 0 if the last loop was in open mode, respectively. Let it now be assumed that the last loop was in closed mode, the second D flip flop 543 generates an output of 1 which is applied to the AND circuit 544 directly, and to the AND circuit 545 by way of an inverter 547, respectively.

On the other hand, the lean/rich state-discriminating signal generated by the lean/rich state comparator 516 shown in detail in FIG. 10 is applied to the D-input terminal of a third D flip flop 548, which is arranged to generate a flag signal indicative of the output level of the $O_2$ sensor 15 occurring in the present loop. The D flip flop 548 generates outputs of 1 and 0 at its Q-output terminal, respectively, when supplied with a lean state-indicative signal and a rich state-indicative signal, upon application of a clock pulse CP1 thereto. Connected to the third D flip flop 548 is a fourth D flip flop 549 which is arranged to generate a flag signal indicative of the output level of the $O_2$ sensor 15 occurring in the last loop. The D flip flop 549 generates outputs of 1 and 0 at its Q-output terminal, respectively, if the $O_2$ sensor output in the last loop showed a lean state of the mixture and a rich state thereof, in a manner similar to that just mentioned above. Therefore, if there is an inversion in the level of the lean/rich state-discriminating signal between the present loop and the last loop, the third and fourth D flip flops 548, 549 have different output levels to each other, for instance, when one has a high level output of 1, the other has a low level output of 0. The two flip flops 548 and 549 have their outputs applied to an exclusive OR circuit 550. Thus, when there occurs an inversion in the level of the lean/rich state-discriminating signal, the different outputs of the flip flops 548 and 549 cause the exclusive OR circuit 550 to generate an output of 1, which is applied to the aforementioned AND circuits 544 and 545 directly, and to the AND circuit 546, by way of an inverter 551, respectively.

Let it now be assumed that the present loop is in closed mode, while the last loop was also in closed mode, the AND circuit 544 has all of its input terminals supplied with outputs all having a high level of 1 from the flip flops 542 and 543 and the exclusive OR circuit 550, and accordingly generates an output of 1, when there occurs an inversion in the level of the lean/rich state-discriminating signal between the present loop and the last loop. The above output of 1 of the AND circuit 544 is used as a proportional term control (P-term control) command signal for proportional term control of the air/fuel ratio, as hereinlater described. Incidentally, in the above-assumed state, the AND circuits 545 and 546 each have one input terminal supplied with an output of 0 by way of a corresponding one of the inverters 547 and 551, so that an OR circuit 552, which is connected to the outputs of the AND circuits 545 and 546, generates an output of 0. It is so arranged that the integral term control (I-term control) of the air/fuel ratio is carried out when the output of the OR circuit 552 has a high level, and therefore the integral term control operation is not effected on this occasion.

On the contrary, if there occurs no inversion in the level of lean/rich state-discriminating signal between the present loop and the last loop, the output level of the AND circuit 544 is low to prevent execution of the P-term control operation, whereas the output level of the AND circuit 546 is high so that the OR circuit 552 generates an I-term control command signal for carrying out the I-term control operation.

Also if the last loop was in open mode, the output of the AND circuit 544 is 0 to inhibit execution of the P-term control operation, whereas the output of the flip flop 543 is 0 so that the output of the AND circuit 545, which is supplied with an output of 1 of the inverter 547 which inverts the above output of 0 of the flip flop 543, is 1 to cause execution of the I-term control operation.

The above-described operations are all applicable when the present loop is in closed mode. On the other hand, when the present loop is in open mode, the output of the first D flip flop 542 is 0 so that the AND circuits 544, 545 and 546 all generate an output of 0 to inhibit execution of both the P-term control and the I-term control.

At the termination of the present loop operation, the second and fourth D flip flops 543 and 549 are again set by a clock pulse CP6 to generate a flag signal indicative of the present loop engine operating condition and a flag signal indicative of the $O_2$ sensor output level, respectively.

The I-term control operation of the circuit of FIG. 11 will now be described. When the OR circuit 552 generates an output of 1 commanding the I-term control operation, this high output is applied to one input terminal of each of the AND circuits 553 and 554. On this occasion, if the lean/rich state-discriminating signal outputted from the lean/rich state comparator circuit 516 in FIGS. 9 and 10 has a high level, that is, the mixture being supplied to the engine is lean, the AND circuit 553 has another input terminal supplied directly with the above output of 1 of the third D flip flop 548, while simultaneously the other AND circuit 554 has another input terminal supplied with a low level signal of 0 by way of an inverter 555. That is, the AND circuit 553 is opened when the $O_2$ sensor output shows that the mixture is lean. When supplied with the above output of 1, the AND circuit 553 generates a single pulse each time a clock pulse CP2 is applied thereto, and applies it to and NIL value counter 556, which counts the number of pulses supplied from the AND circuit 553 and applies its count to a comparator 557 as input $B_6$. The comparator 557 compares this count $B_6$ with a predetermined value NI inputted as input $A_6$ from an NI value memory 558, and generates an output of 1 when the input relationship of $A_6=B_6$ stands, which is applied to a fifth D flip flop 559 at its D-input terminal. The fifth D flip flop 559, which is then in a state resetted by a clock pulse CP1, generates an output of 1 at its Q-output terminal upon application of a clock pulse CP3 thereto, and applies it to one input terminal of a three-input type AND circuit 561, as a $\Delta k$ adding command signal. On this occasion, the AND circuit 561 has another input terminal supplied with the I-term control command signal of 1 from the OR circuit 552. When supplied with the two high level signals of 1 at the same time, the AND circuit 561 allows supply of a $\Delta k$ value stored in a memory 562 and equivalent to a correction amount to be added to the value of $KO_2$ at one time, to an adder 564 as input Y, through an OR circuit 563. The adder 564 already stores a $KO_2$ value occurring in the last loop and inputted thereto as input X, and adds the above $\Delta k$ value to the last loop $KO_2$ value, and applies the resultant sum X+Y to a $KO_2$ value auxiliary register 565 upon application of a clock pulse CP4 thereto. The register 565 in turn applies the stored value X+Y to a $KO_2$ value register 566 upon application of a clock pulse CP5 thereto, thus renewing the $KO_2$ value. This renewed $KO_2$ value is applied to the adder 564 to be used as a last loop $KO_2$ value in the next loop operation. The above clock pulse CP5 is also supplied to one input terminal of an AND circuit 560 which has its other input terminal supplied with the aforementioned $\Delta k$ value adding command signal from the D flip flop 559. Accordingly, the AND circuit 560 generates a single pulse and applies it to the NIL value counter 556 through an OR circuit 567, as a reset signal to reset the counter 556 to zero. Incidentally, so long as the count value $B_6$ inputted to the comparator 557 does not reach the predetermined NI value $A_6$ stored therein, the aforementioned $\Delta k$ value adding command signal is not generated from the D flip flop 559 so that the input value Y inputted to the adder 564 is zero, and accordingly the stored values in the $KO_2$ value auxiliary register 565 and the $KO_2$ value register 566 remain unchanged even when clock pulses CP4 and CP5 are applied to them, thus maintaining the $KO_2$ value occurring in the last loop.

Incidentally, upon inversion of the level of the lean/rich state-discriminating signal, the above clock pulse CP5 is inputted to one input terminal of an AND circuit 568 which is supplied at its other input terminal with an output of 1 from the exclusive OR circuit 550 so that the AND circuit 568 generates a signal pulse and applies it to the NIL value counter 556 through the OR circuit 567, to reset the counter 556 to zero.

On the other hand, when the lean/rich state-discriminating signal generated from the lean/rich state comparator 516 is low, that is, the mixture is rich, this low level signal is applied to the above AND circuit 553 to cause it to generate an output of 0 so that the aforementioned $\Delta k$ value adding operation is not effected, whereas the low level output of the AND circuit 553 is inverted into a high level by the inverter 555 and then applied to one input terminal of the AND circuit 554. The AND circuit 554, which has its other input terminal supplied with the output of 1 from the OR circuit 552 as previously noted, then applies a single pulse to an NIH value counter 569 each time a clock pulse CP2 is applied to the circuit 554. After this, a $\Delta k$ value subtracting operation is carried out, in a manner similar to the aforedescribed $\Delta k$ value adding operation. More specifically, a comparator 570 compares a count inputted thereto as input $A_7$ from the NIH value counter 569 with a predetermined NI value inputted thereto as input $B_7$ from the NI value memory 558, to generate an output of 1 when the former value $A_7$ reaches the latter value $B_7$, that is, the input relationship of $A_7=B_7$ stands, and apply it to a sixth D flip flop 571 which is then in a state resetted by a clock pulse CP1. Thereafter, upon application of a clock pulse CP3 to the D flip flop 571, it generates an output of 1 and applies it to an AND circuit 572 as a $\Delta k$ value subtracting command signal so that the $\overline{\Delta k}$ value stored in a $\overline{\Delta k}$ value memory 573 ($\overline{\Delta k}$ is the two's complement of $\Delta k$) is applied through the AND circuit 572 and the OR circuit 563 to the adder 564, where the input $\overline{\Delta k}$ value Y is added to the input $KO_2$ value occurring in the last loop to substantially obtain a differential value between the $KO_2$ value and a corresponding $\Delta k$ value. This differential value is loaded into the $KO_2$ value auxiliary register 565 and the $KO_2$ value register 566, respectively, upon application of clock pulses CP4 and CP5 to these registers, thus obtaining a renewed $KO_2$ value. Like the aforedescribed $\Delta k$ value adding operation, the above clock pulse CP5 is also supplied to the NIH value counter 569 through the AND circuit 574 and the OR circuit 575, to reset the counter 569 to zero.

Except for the operation just described above, the $\Delta k$ value subtracting operation is carried out in a manner similar to the aforedescribed $\Delta k$ value adding operation, detailed description of which is therefore omitted.

Next, the P-term control operation will now be described. In the event that the present loop is in closed mode as the last loop was, and there occurs an inversion in the level of the $O_2$ sensor output between the present loop and the last loop, the AND circuit 544 applies an output of 1 as a P-term control command signal to one input terminal of each of the AND circuits 576 and 578. Immediately after the mixture has turned lean, the AND circuit 576 is supplied at another input terminal with an output of 1 from the lean/rich state comparator 516 in FIG. 10. As long as the above high level output is supplied to the AND circuit 576, it allows a correction value Pi inputted thereto at its last input terminal from a PI value memory 577 to be applied to the adder 564 as input Y through the OR circuit 564. After this, the Pi value is added to the last loop $KO_2$ value at the adder 564 and the resultant sum is loaded into the $KO_2$ value auxiliary register 565 and the $KO_2$ value register 566 for renewal of the $KO_2$ value in a manner identical with the Δk value adding or subtracting operation during the I-term control operation previously described.

On the other hand, immediately after the mixture has turned rich, the lean/rich state comparator 516 generates an output of 0 which is then inverted into a high level by the inverter 555 and applied to the AND circuit 578. Since the AND circuit 578 is also supplied with the P-term control command signal of 1, it allows a correction value $\overline{PI}$ inputted thereto from a $\overline{Pi}$ value memory 579 to be applied to the adder 564 as input Y through the OR circuit 563. Since this value $\overline{Pi}$ is the two's complement of the above-mentioned value Pi, substantial subtraction of the Pi value from the last loop $KO_2$ value is effected at the adder 564, and the resultant differential value is loaded into the register 565 and 566, in the aforedescribed manner.

Incidentally, the Pi value memory 577 and the $\overline{Pi}$ value memory 579 are connected to the engine rpm sensor 11 and the absolute pressure sensor 8, both appearing in FIG. 1, in such a manner that suitable Pi and $\overline{Pi}$ values are selected from a plurality of predetermined stored values Pi and $\overline{Pi}$, depending upon the output values of these sensors, and are supplied to the AND circuits 576 and 578.

Figure 12:
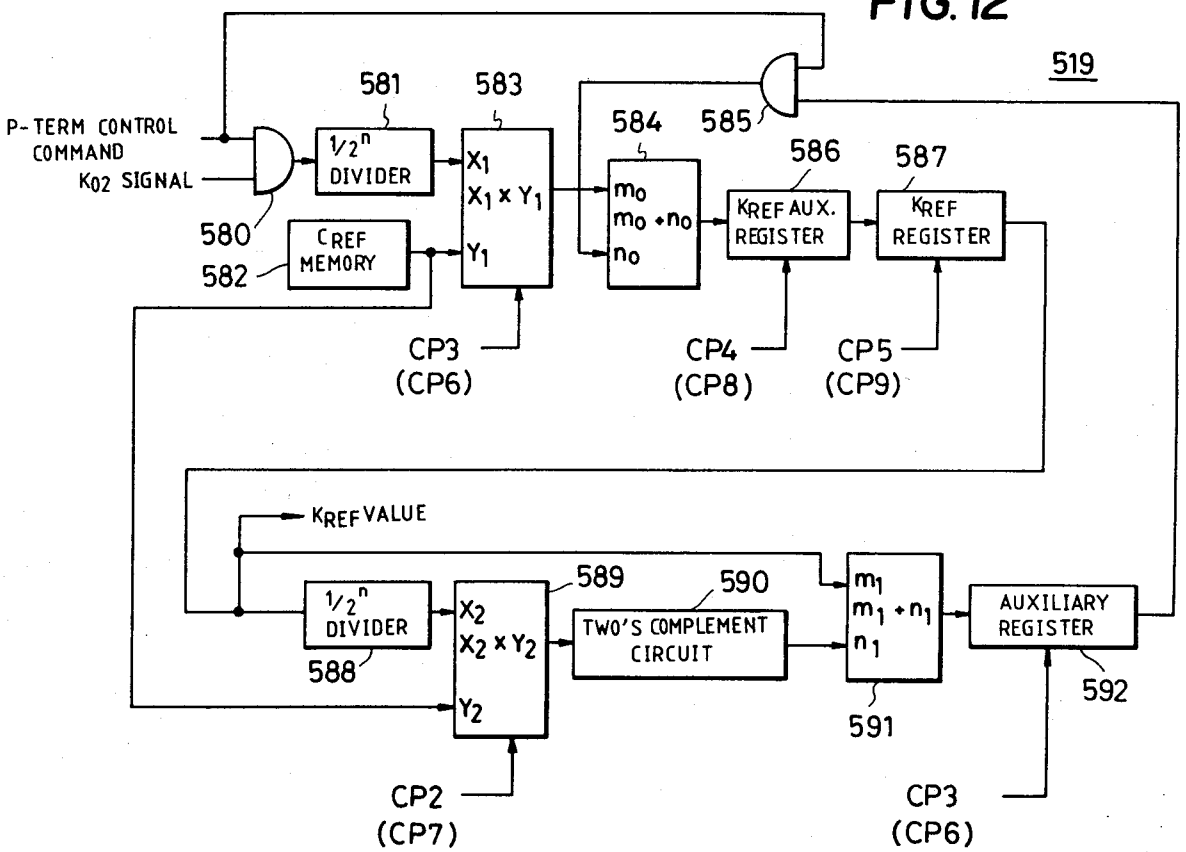
FIG. 12 is a circuit diagram illustrating details of a mean value calculating circuit in FIG. 9.

FIG. 12 illustrates an example of the internal arrangement of the mean value calculating circuit 519 for calculating the mean value KREF of the correction coefficient $KO_2$, shown in FIG. 9. The illustrated circuit is adapted to calculate the mean value KREF according to the aforementioned equation (6). In the figure and the following description, in the case that clock pulses CP2–5 generated by the sequential clock generator 502 are applied to various portions of the circuit 519, $KO_2$ values ($KO_2p$) occurring immediately before P-term control actions are used for calculation of the KREF value, whereas in the case that clock pulses CP6–9, which are parenthesized, are applied to the above portions, $KO_2$ values ($KO_2p$) occurring immediately after P-term control actions are used for the above calculation. A $KO_2$ value signal stored in the $KO_2$ value register 566 in FIG. 11 is supplied to an AND circuit 580 at its one input terminal, which has its other input terminal supplied with a P-term control command signal from the AND circuit 544 of the $KO_2$ value calculating circuit 517 in FIG. 11. When the AND circuit 580 is supplied at the above other input terminal with this P-term control command signal, it allows the $KO_2$ value signal (hereinafter called "$KO_2p$" since it is calculated at each P-term control action) applied to its one input terminal to be applied to a $\frac{1}{2}^n$ divider 581 which is connected to the output of the AND circuit 580. In the $\frac{1}{2}^n$ divider 581, this input value $KO_2p$ is divided by a number $2^n$ corresponding to the constant A, and the resultant quotient $KO_2p/A$ is applied to a multiplier 583 as input $X_1$, which is connected to the output of the $\frac{1}{2}^n$ divider 581. The multiplier 583 is also supplied with a variable CREF value signal as input $Y_1$ so that it carries out a multiplication of the input $X_1$ by the input $Y_1$ to obtain a product $(CREF/A)\times KO_2p$. The product $(CREF/A)\times KO_2p$ is then applied as input $m_o$ to an adder 584 connected to the multiplier 583, upon application of a clock pulse CP3 (CP6) to the latter. At the same time, the above clock pulse CP3 (CP6) is also applied to a KREF value auxiliary register 592 to cause a value $$\frac{A - CREF}{A} \times KREF,$$

which was calculated in the last loop, as described later, and stored in the register 592, to be applied to one input terminal of an AND circuit 585. The AND circuit 585 is supplied at its other input terminal with the aforementioned P-term control command signal, to allow the above calculated value $$\frac{A - CREF}{A} \times KREF$$

to be applied to the above adder 584 as input $n_o$ through the AND circuit 585. At the adder 584, the input $m_o$ and the input $n_o$ are added to obtain a sum $m_o+n_o$, that is, $$\frac{CREF}{A} \times KO_2p + \frac{A - CREF}{A} \times KREF$$

as a new mean value KREF. This new KREF value is loaded into a KREF value auxiliary register 586 upon application of a clock pulse CP4 (CP8) thereto, and then loaded into a KREF value register 587 upon application of a clock pulse CP5 (CP9) thereto. This new KREF value is used as a correction coefficient for correcting the valve opening period TOUTM, TOUTS during an open loop control operation immediately following the present closed loop control operation, as previously described.

Next, the manner of calculating the aforementioned value $$\frac{A - CREF}{A} \times KREF$$

will now be described. A coefficient value KREF, which has been stored into the KREF value register 587, is then applied to a $\frac{1}{2}^n$ divider 588 connected to the output of the register 587, where it is divided by a number $2^n$ equivalent to the constant A. The resultant quotient KREF (=KREF')/A is inputted as input $X_2$ to a multiplier 589 connected to the output of the divider 588. The multiplier 589 is also applied as input $Y_2$ with a value CREF stored in the aforementioned CREF value memory 582, to carry out a multiplication of the input $X_2$ by the input $Y_2$ to obtain a product $X_2\times Y_2$, that is, $$\frac{CREF}{A} \times KREF.$$

This product is applied to a two's complement circuit 590 connected to the output of the circuit 589 upon application of a clock pulse CP2 (CP7) to the latter. The two's complement circuit 590 applies an output signal indicative of the two's complement of the value (CREF/A)×KREF' as input $n_1$ to an adder 591 connected to the output of the circuit 590. The adder 591 is also supplied as input $m_1$ with a value KREF (=KREF') stored in the KREF value register 587, to add the above two's complement value $n_1$ and the KREF value $m_1$. The sum $m_1+n_1$ is substantially equal to a difference obtained by subtracting the value (CREF/A)×KREF' from the value KREF', thus calculating a value $$\frac{A - CREF}{A} \times KREF$$

in the manner of $$KREF - \frac{CREF}{A} \times KREF = \frac{A}{A} \times KREF - \frac{CREF}{A} \times KREF = \frac{A - CREF}{A} \times KREF.$$

This calculated value is loaded into the auxiliary register 592 connected to the output of the adder 591, upon application of a clock pulse CP3 (CP6) to the register 592, to be used for calculating a new KREF value as previously described.

Figure 13:
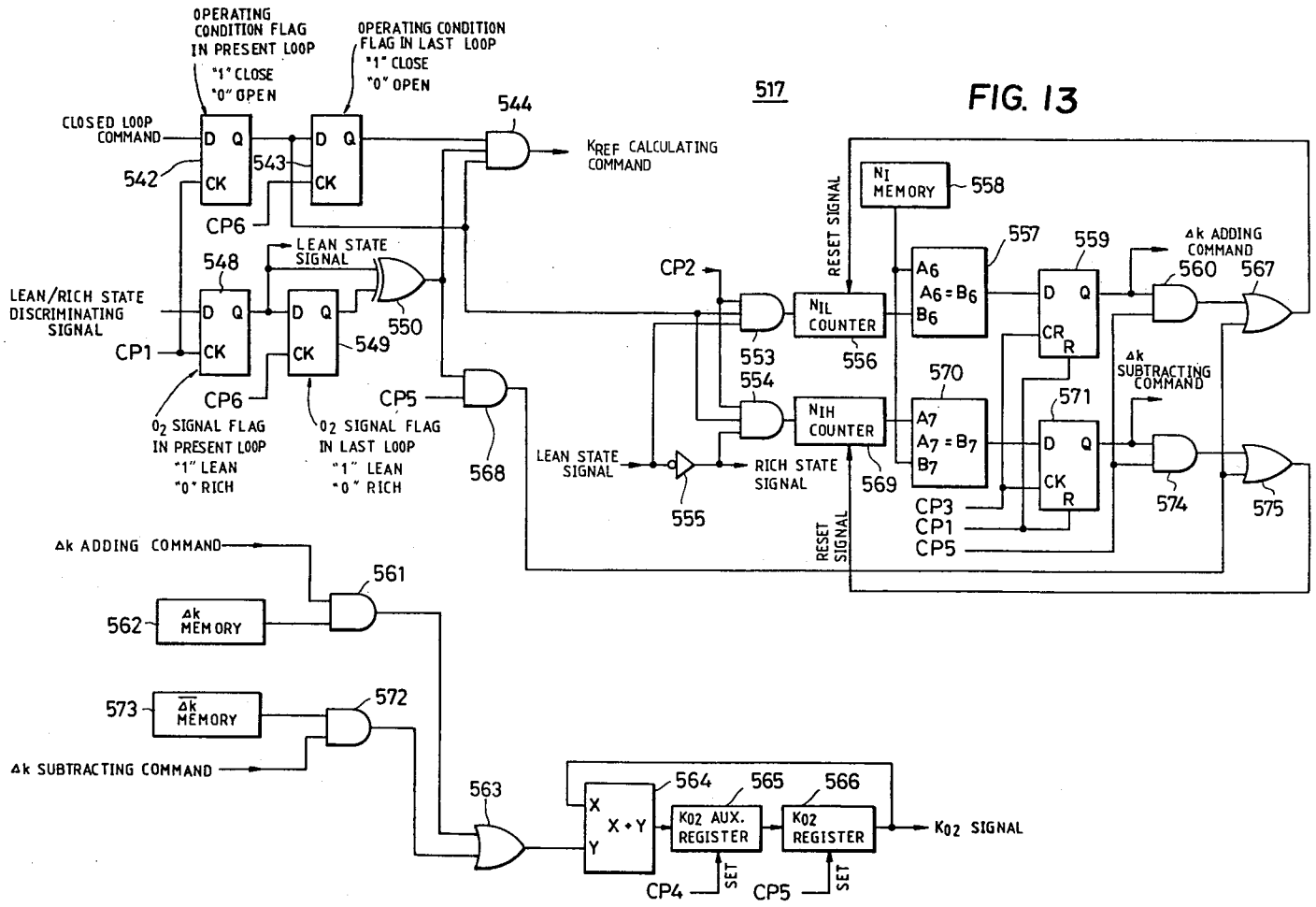
FIG. 13 is a circuit diagram illustrating details of another example of the $KO_2$ value calculating circuit in FIG. 9.

FIG. 13 illustrates another example of the $KO_2$ value calculating circuit in FIG. 9. In FIG. 13, elements corresponding to those in FIG. 11 are designated by identical reference numerals. While the aforedescribed arrangement of FIG. 11 is adapted to correct the value of $KO_2$ by means of proportional term control each time an inversion occurs in the $O_2$ sensor output level, and by means of integral term control so long as no inversion occurs in the $O_2$ sensor output level, respectively, the arrangement of FIG. 13 is adapted to correct the value of $KO_2$ solely by means of integral term control. More specifically, the $KO_2$ value is corrected in such a manner that so long as no inversion occurs in the $O_2$ sensor output level, the $KO_2$ value is increased or decreased by an amount Δk in response to whether the $O_2$ sensor output level is high or low, and when an inversion occurs in the same output level, the direction of correcting the $KO_2$ value is reversed, that is, a Δk value adding action is changed over to a Δk value subtracting action, or vice versa.

In the FIG. 13 arrangement, AND circuits 553 and 554 each have one input terminal connected directly to the Q-output terminal of a first D flip flop 542. On the other hand, AND circuits 561 and 572 are both a two-input type, and each are arranged to be supplied solely with a Δk value adding command signal and a Δk value stored in a Δk value memory 562, and a Δk value subtracting command signal and a $\overline{\Delta k}$ value stored in a $\overline{\Delta k}$ value memory 573, respectively. Connected to the outputs of these AND circuits 561 and 572 is a two-input type OR circuit 563. Further, it will be noted that the FIG. 13 arrangement contains none of elements corresponding to the Pi value memory 577, the $\overline{Pi}$ value memory 579 and the AND circuits 576 and 578 which form the P-term control section of the FIG. 11 arrangement. The other portions than described above are arranged in an identical manner as those in the FIG. 11 arrangement.

Assuming now that the present loop is in open mode, the Q-output of the first D flip flop 542 is 0, as mentioned with reference to FIG. 11, which output is applied to the AND circuits 553 and 554 so that no I-term control action takes place. On the other hand, if the present loop is in closed mode, the Q-output of the first D flip flop 542 is 1, which output is applied directly to the AND circuits 553 and 554 to effect the I-term control operation. To be concrete, in the same manner as mentioned with reference to FIG. 11, either the AND circuit 553 or the AND circuit 554 is selectively opened depending upon the level of the Q-output of a third D flip flop 548 which corresponds to the output level of the $O_2$ sensor 15, to cause generation of the Δk value adding command signal or the Δk value subtracting command signal. This command signal is applied to a corresponding one of the AND circuits 561, 572 so that a $KO_2$ value correcting operation is then carried out in a manner similar to that described with reference to FIG. 11. In the above I-term control operation, also when an inversion occurs in the output level of the $O_2$ sensor, that is, an inversion occurs in the Q-output level of the third D flip flop 548, the I-term control operation is continued, since the Q-output of 1 of the first D flip flop 542 is always applied to the AND circuits 533, 554, in such a manner that an inversion in the Q-output level of the third D flip flop 548 causes corresponding inversions in the output levels of the AND circuits 553, 554 to cause changeover from the Δk value adding action to the Δk value subtracting action or vice versa, in the same manner as described with reference to FIG. 11.

An output pulse of an AND circuit 544, which is generated upon each inversion of the output level of the $O_2$ sensor 15, is applied to the AND circuit 580 of the mean value KREF calculating circuit 519 of FIG. 12 as a KREF value calculating command signal, like the arrangements of FIG. 11 and FIG. 12.

Figures 14, 14A:
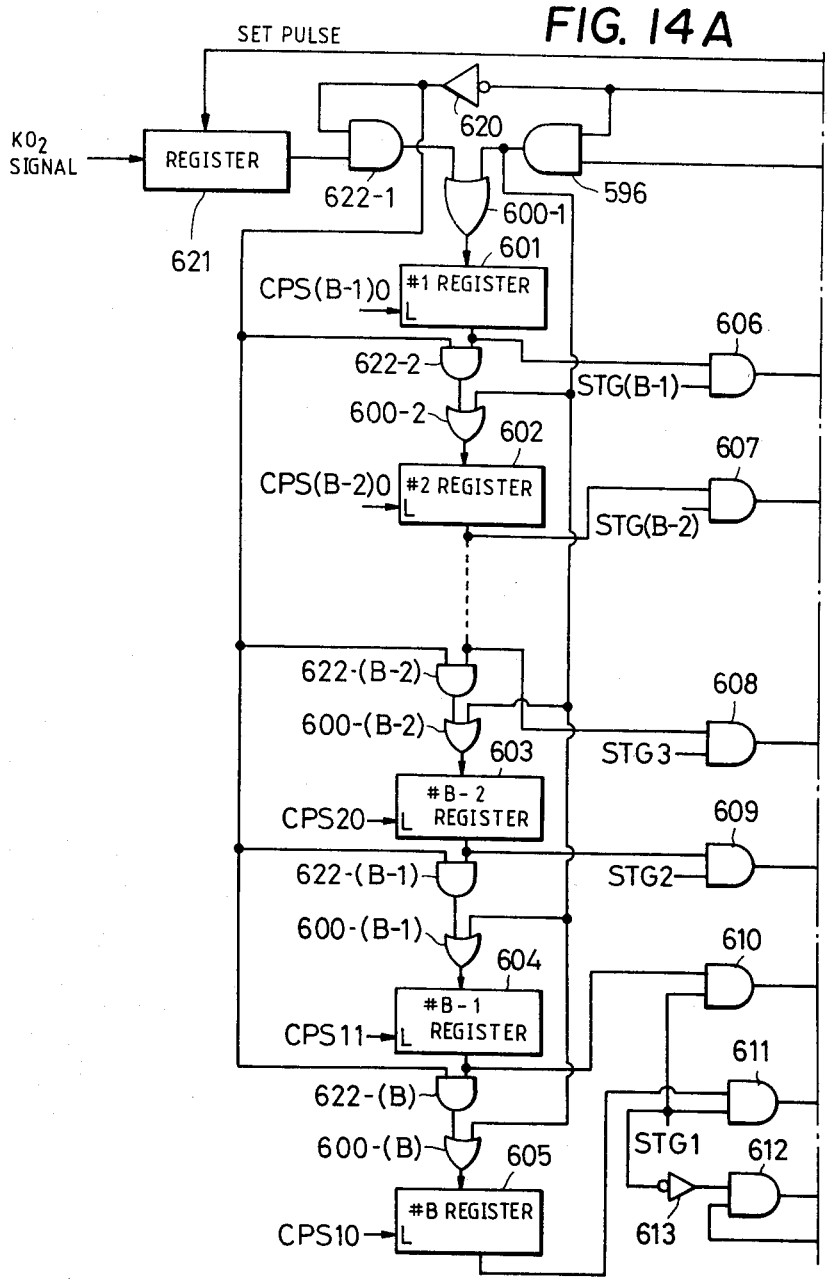
FIGS. 14A and 14B illustrate a circuit diagram illustrating details of another example of the mean value calculating circuit in FIG. 9.
Figure 14B:
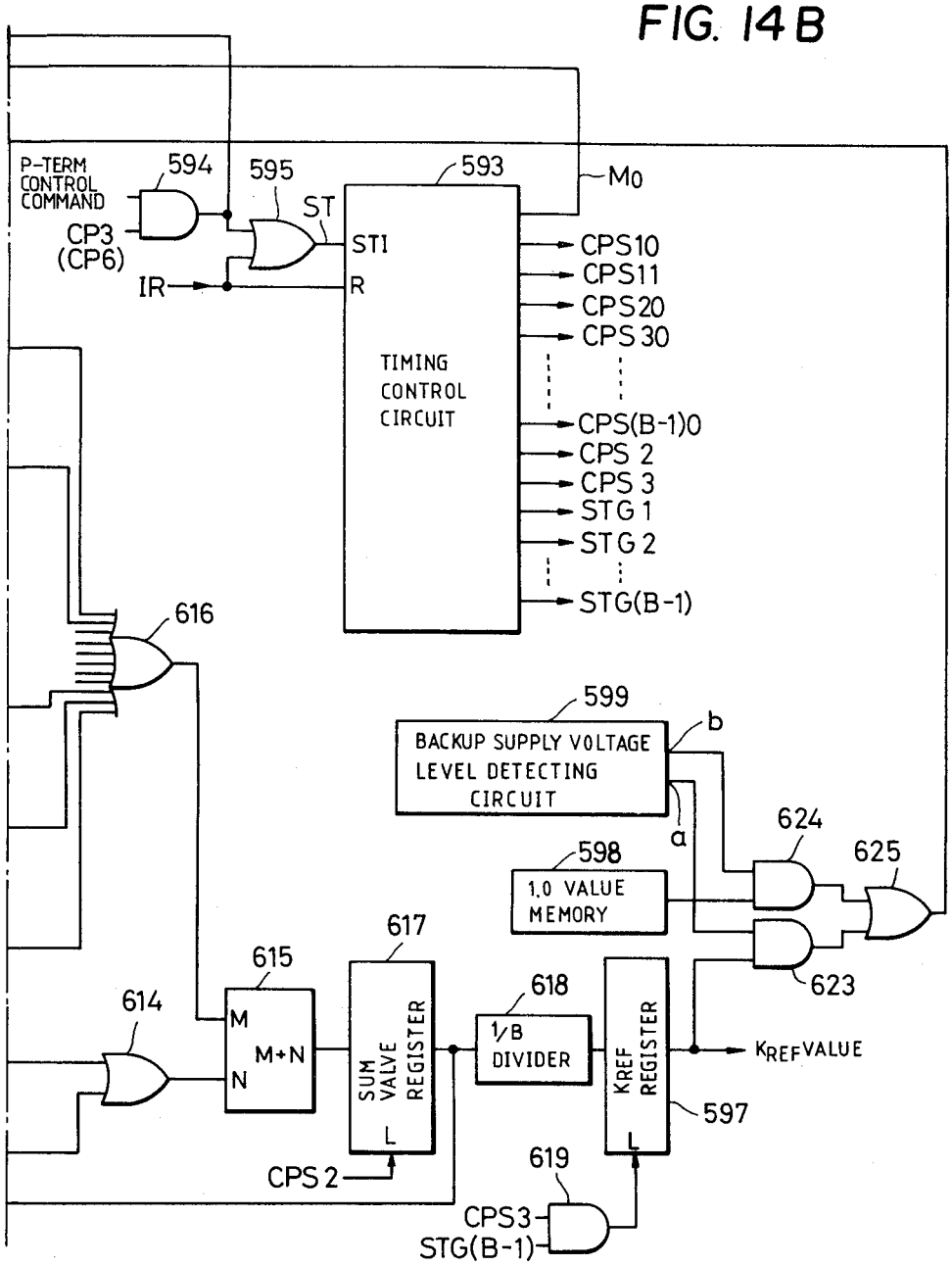
Figure 15:
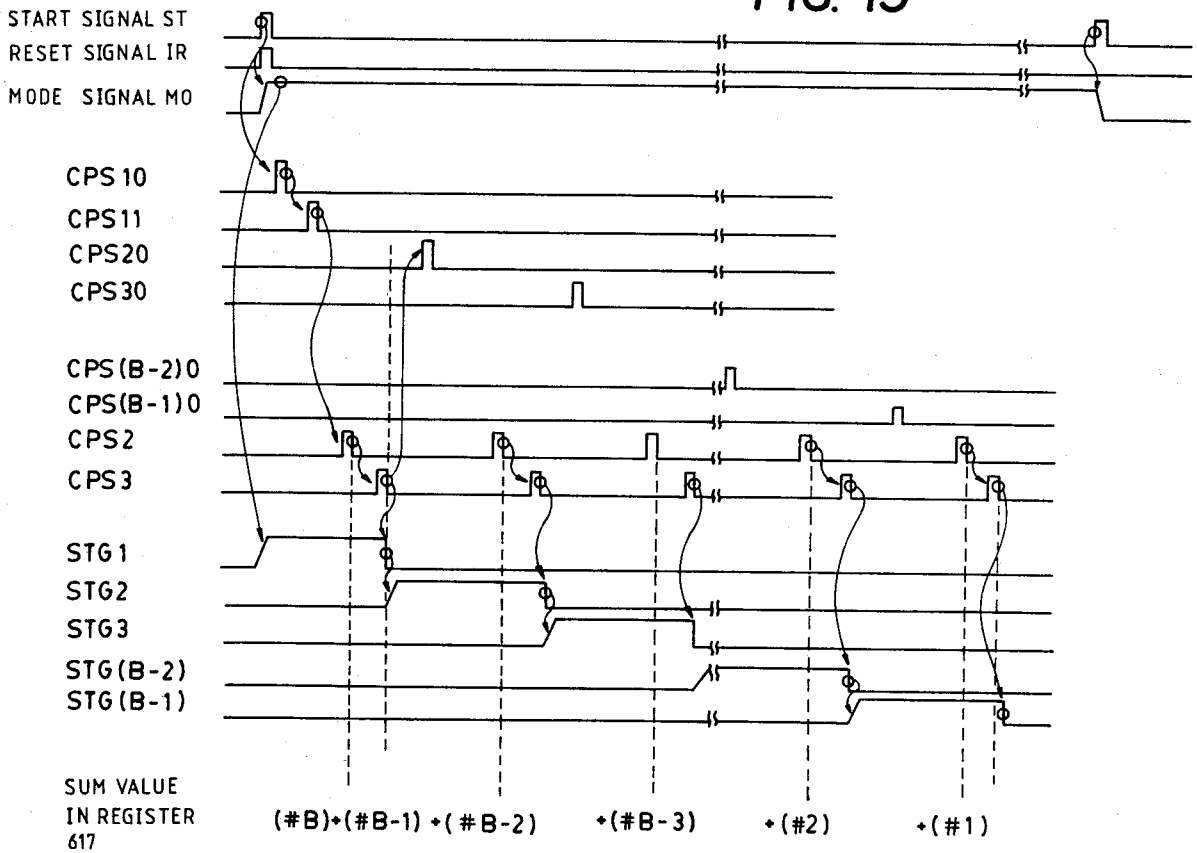
FIG. 15 is a timing chart showing the relationship between various signals generated in the circuit of FIG. 14.

FIG. 14 illustrates another example of the KREF value calculating circuit 519 in FIG. 9. According to the FIG. 14 arrangement, the KREF value is calculated by the aforementioned equation (7). FIG. 15 shows a timing chart of signals for control of the operating timing of the circuit of FIG. 14. At the start of an engine operation, a reset signal IR, which is generated by a suitable reset signal generator, not shown, and operable in synchronism with closing of the engine ignition switch, is applied directly to a reset signal input terminal R of a timing control circuit 593 and also to a start signal input terminal STI of same as a start signal through an OR circuit 595 (a similar reset signal may be applied to the above input terminals R and STI, also when there occurs a temporary drop in the supply voltage). On the other hand, during P-term control operation, the P-term control command signal having a high level of 1 generated by the AND circuit 544 in FIG. 11 is applied to one input terminal of an AND circuit 594 which is supplied at its other input terminal with a clock pulse CP3 or CP6 from the sequential clock generator 501 in FIG. 9. In the case of detecting (calculating) the $KO_2pj$ value of the equation (7) at an instant immediately before each P-term control action, the clock pulse CP3 is supplied to the AND circuit 594, and in the case of detecting the $KO_2pj$ value at an instant immediately after each P-term control action, the clock pulse CP6 is supplied to the same circuit. Each time the AND circuit 594 is supplied with a clock pulse CP3 (CP6), it generates an output of 1 and applies it as a start signal ST to the start signal input terminal STI of the timing control circuit 593 through the OR circuit 594. Upon concurrent application of inputs of 1 to the input terminals STI and R, the circuit 593 generates a mode signal Mo having a high level of 1 (FIG. 15), and applies it to one input terminal of an AND circuit 596. The AND circuit 596 is supplied at its other input terminal with KREF value data indicative of a KREF value obtained at the termination of the last engine operation, from a KREF value register 597, which data is usually permitted to be supplied to the AND circuit 596 by a backup supply voltage level detecting circuit 599, as hereinlater described. The AND circuit 596 which is opened by the mode signal of 1 allows supply of the above KREF value data to all of #1 register 601 through #B register 605, via respective OR circuits 600-1-600-B.

On the other hand, when supplied with each start signal ST, the timing control circuit 593 generates sequential control clock pulses in the order of CPS 10, 11, 2, 3; CPS 20, 2, 3; CPS 30, 2, 3; . . . CPS (B-2)0, 2, 3; CPS (B-1)0, 2, 3, as shown in FIG. 15. The circuit 593 also generates a stage signal STG in the order of STG1, STG2, STG3 . . . STG(B-2) and STG(B-1), simultaneously with generation of the start signal ST of 1, and supplies the clocks pulses and the stage signals to various portions of the circuit of FIG. 14. First, the stage pulse STG1 is applied to an AND circuit 611, which is in turn opened to allow a value stored in a #B register 605 to be applied as input N to an adder 615 through an OR circuit 614. The above stage STG1 is also supplied to an AND circuit 610 to allow a value stored in a #B-1 register 604 to be applied as input M to the adder 615 through an OR circuit 616. Then, the adder 615 performs an adding operation of M+N, i.e. a sum of values stored in the #B register 605 and #B-1 register 604. Upon generation of a pulse STG1 of the stage signal STG, a clock pulse CPS10 is applied to the #B register 605 to cause the KREF value stored in the KREF value register 597 to be loaded into the former as value (#B). Then, a clock pulse CPS11, which is generated immediately after the clock pulse CPS10, is applied to the #B-1 register 604 to cause the KREF value stored in the KREF value register 597 to be loaded into the former as value (#B-1). A further clock pulse CPS2 following the clock pulse CPS11 is applied to a sum value register 617 so that the sum M+N=(#B)+(#B-1) calculated by the adder 615 is loaded into the former. The sum (#B)+(#B-1) is applied to a 1/B divider 618 where it is divided by the constant B into a quotient (#B)+(#B-1)/B.

When a further clock pulse CPS3 is generated, the stage pulse STG1 goes low, and simultaneously a second stage pulse STG2 goes high. On this occasion, an AND circuit 612, which is already supplied with the output value (#B)+(#B-1) of the sum value register 617, is opened by an inverter 613 upon the above going-low of the stage pulse STG1 to apply the above sum value (#B)+(#B-1) to the adder 615 as input N through an OR circuit 614. The above pulse STG2 of 1 is applied to an AND circuit 609 to open same so that a value stored in the #B-2 register 603 is applicable as input M to the adder 615 through the OR circuit 616 for adding operation of M+N, i.e. (#B)+(#B-1)+(#B-2). Upon generation of a clock pulse CPS20, the KREF value stored in the KREF value register 597 is loaded into the #B-2 register as value (#B-2), and the resultant sum of (#B)+(#B-1)+(#B-2), all being the KREF value, is applied to the sum value register 617 upon application of a next clock pulse CPS2 thereto, and then subjected to division by the constant B into a quotient (#B)+(#B-1)+(#B-2)/B. Thereafter, similar adding operations are successively carried out in such a manner that values (hereinafter called "(#2)", "(#1)") stored, respectively, in the #1 register 601, a #2 register 602, etc. are successively applied to the adder 615 through corresponding AND circuits 608, 607, 606, etc. and the OR circuit 616, in synchronism with generation of further stage pulses STG3, . . . STG(B-2), STG(B-1), and further clock pulses CPS30, . . . CPS(B-2)0, CPS(B-1)0. When the pulse CPS3 of the last clock pulse group (CPS(B-1)0, CPS2 and CPS3) is applied to an AND circuit 619 which is then supplied with the stage pulse STG(B-1), the AND circuit 619 generates a single pulse and applies it to the KREF value register 597 to cause a sum of (#B)+(#B-1)+(#B-2) . . . (#2)+(#1)/B so far calculated by the 1/B divider 618 to be loaded into the above register 597 as a new KREF value.

Then, when a second start signal ST following the aforementioned first start signal ST, which is caused by generation of a proportional term control command signal, is applied to the timing control circuit 593 through the AND circuit 594 and the OR circuit 595, the mode signal Mo then goes low and thereafter remains at a low level throughout the present engine operation irrespective of application of subsequent start signals ST, since no reset signal is inputted to the input terminal R thereafter (except when there occurs a drop in the supply voltage). This causes the AND circuit 596 to be closed to interrupt supply of the KREF value obtained at the termination of the last engine operation to all of the #1 register 601 through the #B register 605. At the same time, the above mode signal Mo of 0 is inverted in level into 1 by an inverter 620 and then applied to AND circuits 622-1 through 622-B to open same. The output terminals of the AND circuits 622-1 through 622-B are connected to the other input terminals of respective OR circuits 600-1 through 600-B. Upon generation of a pulse STG1 of the stage signal STG, a clock pulse CPS10 is applied to the #B register 604 to cause the value stored in the #B-1 register 604, i.e. a value of $KO_2$ obtained at a first one of a B-number of P-term control actions before the present one to be loaded into the former as value (#B). Then, a clock pulse CPS11 immediately following the clock pulse CPS10 is applied to the #B-1 register 604 to cause the value stored in the #B-2 register 603, i.e. a second one of the B-number of P-term control actions before the present one to be loaded into the former as value (#B-1). Then, upon generation of a pulse STG2 of the stage signal STG, a corresponding clock pulse CPS20 is applied to a #B-3 register, not shown, to cause loading of its stored value, i.e. a third one of the B-number of P-term control actions before the present one into the #B-2 register 603 as value (#B-2). Upon further generation of each pulse of the stage signal STG, the above action is repeated. On the other hand, the above second start signal ST is also applied to a register 621 to cause an up-to-date $KO_2$ value in the $KO_2$ value register 566 in FIG. 11 to be loaded into the register 621. The up-to-date $KO_2$ value thus loaded into the register 621 is then loaded into the #1 register 601 through the opened AND circuit 622-1 and the OR circuit 600-1, upon application of the clock pulse CPS (B-1) thereto. After this, the KREF value is calculated by using the above up-to-date $KO_2$ value.

As will be understood from the foregoing description, the KREF value obtained at the termination of the last engine operation is used as an up-to-date $KO_2$ value, for calculation of a new KREF value at the start of an engine operation, which is initiated by closing of the ignition switch. To this end, to retain the KREF value in the KREF register 597 even when the engine is at rest, the KREF register 597 is permanently supplied with a supply voltage from the backup power supply. However, there can occur a drop in the level of the supply voltage of the backup power supply due to exhaustion of the battery or low temperature at the start of the engine. In such an event, all of the #1 register 601 through the #B register 605 are loaded with a value of 1.0 in place of the KREF value obtained at the end of the last engine operation, for calculation of a new KREF value at the start of a subsequent engine operation. More specifically, in FIG. 14, the backup supply voltage level detecting circuit 599 generates an output of 1 at its output terminal a when the backup supply voltage level is higher than a predetermined level, to open an AND circuit 623 to cause the KREF value in the KREF value register 597 to be loaded into all of the #1 register 601 through #B register 605, via an OR circuit 625, etc., while it generates an output of 1 at its output terminal b when the backup supply voltage level is lower than the predetermined level, to open an AND circuit 624 to cause data indicative of a value of 1.0 in a 1.0 value memory 598 to be loaded into the #1 register 601 through #B register 605, via the OR circuit 625, etc., thus obtaining a KREF value falling within a suitable value range.

What is claimed is:

1. An air/fuel ratio feedback control system for controlling the air/fuel ratio of an air/fuel mixture being supplied to an internal combustion engine having an exhaust system, comprising: a sensor arranged in said exhaust system for detecting the concentration of exhaust gases emitted from said engine; means for detecting a plurality of particular operating conditions of said engine; means for detecting at least one engine operating parameter value; means for calculating a basic value of the air/fuel ratio on the basis of at least one detected engine operating parameter value; and electric circuit means responsive to outputs of said exhaust gas concentration sensor and said particular operating condition detecting means to generate a first coefficient variable in response to the output of said exhaust gas concentration sensor and at least one second coefficient variable in response to the output of said particular operating condition detecting means, said first and second coefficients being applied for correction of said basic value; said electric circuit means including means operable when said engine is operating in an operating condition other than said particular operating conditions, to vary the value of said first coefficient in response to the output of said exhaust gas concentration sensor and simultaneously hold the value of said second coefficient at a first predetermined value, means for calculating a mean value of values of said first coefficient obtained when the engine is operating in said operating condition of said engine other than said particular operating conditions, and means operable when said engine is operating in one of said particular operating conditions, to hold the value of said second coefficient at a second predetermined value and simultaneously hold the value of said first coefficient at a third predetermined value, which is said mean value, whereby the air/fuel ratio is close to a desired air/fuel ratio suited for operation of said engine in each of said particular operating conditions.

2. An air/fuel ratio feedback control system for controlling the air/fuel ratio of an air/fuel mixture being supplied to an internal combustion engine having an exhaust system, comprising: a sensor arranged in said exhaust system for detecting the concentration of exhaust gases emitted from said engine; means for detecting a plurality of particular operating conditions of said engine; means for detecting at least one engine operating parameter value; means for calculating a basic value of the air/fuel ratio on the basis of at least one detected engine operating parameter value; and electric circuit means responsive to outputs of said exhaust gas concentration sensor and said particular operating condition detecting means to generate a first coefficient variable in response to the output of said exhaust gas concentration sensor and at least the second coefficient variable in response to the output of said particular operating condition detecting means, said first and second coefficients being applied for correction of said basic value; said electric circuit means including a comparator for comparing an output value of said exhaust gas concentration sensor with a predetermined reference value to generate a binary signal indicative of the difference between said two values, means responsive to said binary signal to correct the value of said first coefficient by means of proportional term control when an inversion occurs in the level of said binary signal, and correct the same value by means of integral term control so long as no inversion occurs in the level of said binary signal, means operable when said engine is operating in an operating condition other than said particular operating conditions, to cause said first coefficient correcting means to perform said first coefficient value correction responsive to said output value of said exhaust gas concentration sensor, and simultaneously hold the value of said second coefficient at a first predetermined value, means for calculating a mean value of values of said first coefficient obtained when the engine is operating in said operating condition of said engine other than said particular operating conditions; and means operable when said engine is operating in one of said particular operating conditions, to hold the value of said second coefficient at a second predetermined value and simultaneously hold the value of said first coefficient at a third predetermined value, which is said mean value, whereby the air/fuel ratio of an air/fuel mixture is close to a desired air/fuel ratio suited for operation of said engine in each of said particular operating conditions.

3. The air/fuel ratio feedback control system as claimed in claim 2, wherein said mean value of said first coefficient comprises a mean value of values of said first coefficient obtained through a plurality of inversions in the level of said binary signal outputted from said comparator, occurring immediately before said engine comes into said one particular operating condition.

4. The air/fuel ratio feedback control system as claimed in claim 3, wherein said mean value of said first coefficient comprises a mean value of values of said first coefficient which are each obtained immediately before said first coefficient correcting means corrects the value of said first coefficient by means of said proportional term control.

5. The air/fuel ratio feedback control system as claimed in claim 4, wherein said mean value of said first coefficient is calculated by the following equation:

$$KREF = \frac{CREF}{A} \times KO_{2p} + \frac{A - CREF}{A} \times KREF$$

where $KO_2p$ represents a value of said first coefficient obtained immediately before a proportional term control action of said first coefficient correcting means, A a constant, CREF a variable set within a range from 1 to A, and KREF' a mean value of said first coefficient obtained at a proportional term control action immediately preceding the present one.

6. The air/fuel ratio feedback control system as claimed in claim 4, wherein said mean value of said first coefficient is calculated by the following equation:

$$KREF = \frac{1}{B} \sum_{j=1}^{B} KO_{2pj}$$

where $KO_2pj$ represents a value of said first coefficient obtained immediately before a first one of a j-number of proportional term control actions of said first coefficient correcting means taking place before the present one, and B a constant equal to a number of proportional term control actions which are subjected to calculation of the mean value.

7. The air/fuel ratio feedback control system as claimed in claim 3, wherein said mean value of said first coefficient comprises a mean value of values of said first coefficient which are each obtained immediately after said first coefficient correcting means corrects the value of said first coefficient by means of said proportional term control.

8. The air/fuel ratio feedback control system as claimed in claim 7, wherein said mean value of said first coefficient is calculated by the following equation:

$$KREF = \frac{CREF}{A} \times KO_{2p} + \frac{A - CREF}{A} \times KREF$$

where $KO_2p$ represents a value of said first coefficient obtained immediately after a proportional term control action of said first coefficient correcting means, A a constant, CREF a variable set within a range from 1 to A, and KREF' a mean value of said first coefficient obtained at a proportional term control action immediately preceding the present one.

9. The air/fuel ratio feedback control system as claimed in claim 7, wherein said mean value of said first coefficient is calculated by the following equation:

$$KREF = \frac{1}{B} \sum_{j=1}^{B} KO_{2pj}$$

where $KO_2pj$ represents a value of said first coefficient obtained immediately after a first one of a j-number of proportional term control actions of said first coefficient correcting means taking place before the present one, and B a constant equal to a number of proportional term control actions which are subjected to calculation of the mean value.

10. An air/fuel ratio feedback control system for controlling the air/fuel ratio of an air/fuel mixture being supplied to an internal combustion engine having an exhaust system, comprising: a sensor arranged in said exhaust system for detecting the concentration of exhaust gases emitted from said engine; means for detecting a plurality of particular operating conditions of said engine; means for detecting at least one engine operating parameter value; means for calculating a basic value of the air/fuel ratio on the basis of at least one detected engine operating parameter value; and electric circuit means responsive to outputs of said exhaust gas concentration sensor and said particular operating condition detecting means to generate a first coefficient variable in response to the output of said exhaust gas concentration sensor and at least one second coefficient variable in response to the output of said particular operating condition detecting means, said first and second coefficients being applied for correction of said basic value; said electric circuit means including a comparator for comparing an output value of said exhaust gas concentration sensor with a predetermined reference value to generate a binary signal indicative of the difference between said two values, means responsive to said binary signal to correct the value of said first coefficient by means of integral term control in a manner reversing the direction of correcting the value of said first coefficient upon each inversion in the level of said binary signal, means operable when said engine is operating in an operating condition other than said particular operating conditions, to cause said first coefficient correcting means to perform said first coefficient value correction responsive to said output value of said exhaust gas concentration sensor, and simultaneously hold the value of said second coefficient at a first predetermined value, means for calculating a mean value of values of said first coefficient obtained when the engine is operating in said operating condition of said engine other than said particular operating conditions; and means operable when said engine is operating in one of said particular operating conditions, to hold the value of said second coefficient at a second predetermined value and simultaneously hold the value of said first coefficient at a third prdetermined value, which is said mean value, whereby the air/fuel ratio is close to a desired air/fuel ratio suited for operation of said engine in each of said particular operating conditions.

11. The air/fuel ratio feedback control system as claimed in claim 10, wherein said mean value of said first coefficient comprises a mean value of values of said first coefficient obtained through a plurality of inversions in the level of said binary signal outputted from said comparator, occurring immediately before said engien comes into said one particular operating condition.

12. The air/fuel ratio feedback control system as claimed in claim 11, wherein said means value of said first coefficient comprises a mean value of values of said first coefficient which are each obtained by said first coefficient correcting means when each inversion occurs in the level of said binary signal outputted from said comparator.

13. The air/fuel ratio feedback control system as claimed in claim 12, wherein said mean value of said first coefficient is calculated by the following equation:

$$KREF = \frac{CREF}{A} \times KO_2 + \frac{A - CREF}{A} \times KREF$$

where $KO_2$ represents a value of said first coefficient obtained when an inversion occurs in the level of said binary signal, A a constant, CREF a variable set within a range from 1 to A, and KREF' a mean value of said first coefficient obtained at an inversion in the level of said binary signal immediately preceding the present one.

14. The air/fuel ratio feedback control system as claimed in claim 12, wherein said mean value of said first coefficient is calculated by the following equation:

$$KREF = \frac{1}{B} \sum_{j=1}^{B} KO_2j$$

where $KO_2j$ represents a value of said first coefficient obtained at a first one of a j-number of inversions in the level of said binary signal taking place before the present one, and B a constant equal to a number of inversions of in the level of said binary signal which are subjected to calculation of the mean value.

15. An air/fuel ratio feedback control system as claimed in claim 1, wherein said electric circuit means includes means for generating a binary signal responsive to the level in the output from said exhaust gas concentration sensor, whereby said mean value calculating means calculates a mean value of values of said first coefficient each obtained at an instant of inversion of said binary signal.

16. A control system for controlling the air/fuel ratio of an air/fuel mixture for an internal combustion engine having an exhaust system, comprising: a sensor arranged in said exhaust system for detecting the concentration of exhaust gases emitted from said engine; means for detecting a plurality of particular operating conditions of said engine; means for determining a basic value of the air/fuel ratio for at least one engine operating condition; and electric circuit means responsive to outputs of said exhaust gas concentration sensor and said particular operating condition detecting means to generate a first coefficient variable in response to the output of said exhaust gas concentration sensor and at least one second coefficient variable in response to the output of said particular operating condition detecting means, said first and second coefficients being applied for correction of said basic values, said electric circuit means including means operable when said engine is operating in an operating condition other than said particular operating conditions, to vary the value of said first coefficient in response to the output of said exhaust gas concentration sensor and simultaneously hold the value of said second coefficient at a first predetermined value, means for calculating a mean value of said varying first coefficient, and means operable when said engine is operating in one of said particular operating conditions, to hold the value of said second coefficient at a second predetermined value and simultaneously hold the value of said first coefficient at a third predetermined value being said mean value.

17. An air/fuel ratio feedback control system for controlling the air/fuel ratio of an air/fuel mixture being supplied to an internal combustion engine having an exhaust system, comprising: a sensor arranged in said exhaust system for detecting the concentration of exhaust gases emitted from said engine; means for detecting a plurality of particular operating conditions of said engine; and electric circuit means responsive to outputs of said exhaust gas concentration sensor and said particular operating condition detecting means to generate a first coefficient variable in response to the output of in exhaust gas concentration sensor and at least one second coefficient variable in response to the output of said particular operating condition detecting means, said first and second coefficients forming factors for determining the air/fuel ratio of said air/fuel mixture, said electric circuit means including a comparator for comparing an output value of said exhaust gas concentration sensor with a predetermined reference value to generate a binary signal indicative of the difference between said two values, means responsive to said binary signal to correct the value of said first coefficient by means of proportional term control when an inversion occurs on the level of said binary signal, and correct the same value by means of integral term control so long as no inversion occurs in the level of said binary signal, means operable when said engine is operating in an operating condition other than said particular operating conditions, to cause said first coefficient correcting means to perform said first coefficient value correction response to said output value of said exhaust gas concentration sensor, and simultaneously hold the value of said second coefficient at a first predetermined value, and means operable when said engine is operating in one of said particular operating conditions, to hold the value of said second coefficient at a second predetermined value and simultaneously hold the value of said first coefficient at a third predetermined value which is a mean value of values of said first coefficient obtained under a predetermined condition when said engine is operating in said operating condition other than said particular conditions, wherein said mean value of said first coefficient comprises a mean value of values of said first coefficient obtained through a plurality of inversions in the level of said binary signal outputted from said comparator, occurring immediately before said engine comes into said one particular operating condition, said mean value being obtained immediately before said first coefficient correcting means corrects the value of said first coefficient by means of said proportional term control and being calculated by the following equation:

$$KREF = \frac{CREF}{A} \times KO_2p + \frac{A - CREF}{A} \times KREF$$

where $KO_2p$ represents a value of said first coefficient obtained immediately before a proportional term control action of said first coefficient correcting means, A a constant, CREF a variable set within a range from 1 to A, and KREF' a mean value of said first coefficient obtained at a proportional term control action immediately preceding the present one.

18. An air/fuel ratio feedback control system for controlling the air/fuel ratio of an air/fuel mixture being supplied to an internal combustion engine having an exhaust system, comprising: a sensor arranged in said exhaust system for detecting the concentration of exhaust gases emitted from said engine; means for detecting a plurality of particular operating conditions of said engine; and electric circuit means responsive to outputs of said exhaust gas concentration sensor and said particular operating condition detecting means to generate a first coefficient variable in response to the output of said exhaust gas concentration sensor and at least one second coefficient variable in response to the output of said particular operating condition detecting means, said first and second coefficients forming factors for determining the air/fuel ratio of said air/fuel mixture, said electric circuit means including a comparator for comparing an output value of said exhaust gas concentration sensor with a predetermined reference value to generate a binary signal indicative of the difference between said two values, means responsive to said binary signal to correct the value of said first coefficient by means of proportional temr control when an inversion occurs in the level of said binary signal, and correct the same value by means of integral term control so long as no inversion occurs in the level of said binary signal, means operable when said engine is perating in an operating condition other than said particular operating conditions, to cause said first coefficient correcting means to perform said first coefficient value correction responsive to said output value of said exhaust gas concentration sensor, and simultaneously hold the value of said second coefffcient at a first predetermined value, and means operable when said engine is operating in one of said particular operating conditions, to hold the value of said second coefficient at a second predetermined value and simultaneously hold the value of said first coefficient at a third predetermined value which is a mean value of values of said first coefficient obtained under a predetermined condition when said engine is operating in said operating condition other than said particular operating conditions, wherein said mean value of said first coefficient comprises a mean value of values of said first coefficient obtained through a plurality of inversions in the level of said binary signal outputted from said comparator, occurring immediately before said engine comes into said one particular operating condition, said mean value of said first coefficient comprises a mean value of values of said first coefficient which are each obtained immediately before said first coefficient correcting means corrects the value of said first coefficient by means of said proportional term control and said mean value of said first coefficient is calculated by the following equation:

$$KREF = \frac{1}{B}\sum_{j=1}^{B} KO_{2pj}$$

where $KO_2pj$ represents a value of said first coefficient obtained immediately before a first one of a j-number of proportional term control actions of said first coefficient correcting means taking place before the present one, and B a constant equal to a number of proportional term control actions which are subjected to calculation of the mean value.

19. An air/fuel ratio feedback control system for controlling the air/fuel ratio of an air/fuel mixture being supplied to an internal combustion engine having an exhaust system comprising: a sensor arranged in said exhaust system for detecting the concentration of exhaust gases emitted from said engine; means for detecting a plurality of particular operating conditions of said engine; and electric circuit means responsive to outputs of said exhaust gas concentration sensor and said particular operating condition detecting means to generate a first coefficient variable in response to the output of said exhaust gas concentration sensor and at least one second coefficient variable in response to the output of said particular operating condition detecting means, said first and second coefficients forming factors for determining the air/fuel ratio of said air/fuel mixture, said electric circuit means including a comparator for comparing an output value of said exhaust gas concentration sensor with a predetermined reference value to generate a binary signal indicative of the difference between said two values, means responsive to said binary signal to correct the value of said first coefficient by means of proportional term control when an inversion occurs in the level of said binary signal, and correct the same value by means of integral term control so long as no inversion occurs in the level of said binary signal, means operable when said engine is operating in an operating condition other than said particular operating conditions, to cause said first coefficient correcting means to perform said first coefficient value correction responsive to said output value of said exhaust gas concentration sensor, and simultaneously hold the value of said second coefficient at a first predetermined value, and means operable when said engine is operating in one of said particular operating conditions, to hold the value of said second coefficient at a second predetermined value and simultaneously hold the value of said first coefficient at a third predetermined value which is a mean value of values of said first coefficient obtained under a predetermined condition when said engine is operating in said operating condition other than said particular operating conditions, wherein said mean value of said first coefficient comprises a mean value of values of said first coefficient obtained through a plurality of inversions in the level of said binary signal outputted from said comparator, occurring immediately before said engine comes into said one particular operating condition, said mean value being obtained immediately after said first coefficient correcting means corrects the value of said first coefficient by means of said proportional term control and being calculated by the following equation:

$$KREF = \frac{CREF}{A} \times KO_{2p} + \frac{A - CREF}{A} \times KREF$$

where $KO_2p$ represents a value of said first coefficient obtained immediately after a proportional term control action of said first coefficient correcting means, A a constant, CREF a variable set within a range from 1 to A, and KREF′ a mean value of said first coefficient obtained at a proportional term control action immediately preceding the present one.

20. An air/fuel ratio feedback control system for controlling the air/fuel ratio of an air/fuel mixture being supplied to an internal combustion engine having an exhaust system, comprising: a sensor arranged in said exhaust system for detecting the concentration of exhaust gases emitted from said engine; means for detecting a plurality of particular operating conditions of said engine; and electric circuit means responsive to outputs of said exhaust gas concentration sensor and said particular operating condition detecting means to generate a first coefficient variable in response to the output of said exhaust gas concentration sensor and at least one second coefficient variable in response to the output of said particular operating condition detecting means, said first and second coefficients forming factors for determining the air/fuel ratio of said air/fuel mixture, said electric circuit means including a comparator for comparing an output value of said exhaust gas concentration sensor with a predetermined reference value to generate a binary signal indicative of the difference between said two values, means responsive to said binary signal to correct the value of said first coefficient by means of proportional term control when an inversion occurs in the level of said binary signal, and correct the same value by means of integral term control so long as no inversion occurs in the level of said binary signal, means operable when said engine is operating in an operating condition other than said particular operating conditions, to cause said first coefficient correcting means to perform said first coefficient value correction responsive to said output value of said exhaust gas concentration sensor, and simultaneously hold the value of said second coefficient at a first predetermined value, and means operable when said engine is operating in one of said particular operating conditions, to hold the value of said second coefficient at a second predetermined value and simultaneously hold the value of said first coefficient at a third predetermined value which is a mean value of values of said first coefficient obtained under a predetermined condition when said engine is operating in said operating condition other than said particular operating conditions, wherein said mean value of said first coefficient comprises a mean value of values of said first coefficient obtained through a plurality of inversions in the level of said binary signal outputted from said comparator, occurring immediately before said engine comes into said one particular operating condition being obtained immediately after said first coefficient correcting means corrects the value of said first coefficient by means of said proportional term control and is calculated by the following equation:

$$KREF = \frac{1}{B}\sum_{j=1}^{B} KO_{2pj}$$

where $KO_2pj$ represents a value of said first coefficient obtained immediately after a first one of a j-number of proportional term control actions of said first coefficient correcting means taking place before the present one, and B a constant equal to a number of proportional term control actions which are subjected to calculation of the mean value.

21. An air/fuel ratio feedback control system for controlling the air/fuel ratio of an air/fuel mixture being supplied to an internal combustion engine having an exhaust system, comprising: a sensor arranged in said exhaust system for detecting the concentration of exhaust gases emitted from said engine; means for detecting a plurality of particular operating conditions of said engine; and electric circuit means responsive to outputs of said exhaust gas concentration sensor and said particular operating condition detecting means to generate a first coefficient variable in response to the output of said exhaust gas concentration sensor and at least one second coefficient variable in response to the output of said particular operating condition detecting means, said first and second coefficients forming factors for determining the air/fuel ratio of said air/fuel mixture, said electric circuit means including a comparator for comparing an output value of said exhaust gas concentration sensor with a predetermined reference value to generate a binary signal indicative of the difference between said two values, means responsive to said binary signal to correct the value of said first coefficient by means of integral term control in a manner reversing the direction of correcting the value of said first coefficient upon each inversion in the level of said binary signal, means operable when said engine is operating in an operating condition other than said particular operating conditions, to cause said first coefficient correcting means to perform said first coefficient value correction responsive to said output value of said exhaust gas concentration sensor, and simultaneously hold the value of said second coefficient at a first predetermined value, and means operable when said engine is operating in one of said particular operating conditions, to hold the value of said second coefficient at a second predetermined value and simultaneously hold the value of said first coefficient at a third predetermined value which is a mean value of values of said first coefficient obtained under a predetermined condition when said engine is operating in said operating condition other than said particular operating conditions, wherein said mean value of said first coefficient comprises a mean value of values of said first coefficient obtained through a plurality of inversions in the level of said binary signal outputted from said comparator, occurring immediately before said engine comes into said one particular operating condition, said mean value being obtained when each inversion occurs in the level of said binary signal outputted from said comparator, and being calculated by the following equation:

$$KREF = \frac{CREF}{A} \times KO_2 + \frac{A - CREF}{A} \times KREF$$

where $KO_2$ represents a value of said first coefficient obtained when an inversion occurs in the level of said binary signal, A a constant, CREF a variable set within a range from 1 to A, and KREF' a mean value of said first coefficient obtained at an inversion in the level of said binary signal immediately preceding the present one.

22. An air/fuel ratio feedback control system for controlling the air/fuel ratio of an air/fuel mixture being supplied to an internal combustion engine having an exhaust system, comprising: a sensor arranged in said exhaust system for detecting the concentration of exhaust gases emitted from said engine; means for detecting a plurality of particular operating conditions of said engine; and electric circuit means responsive to outputs of said exhaust gas concentration sensor and said particular operating condition detecting means to generate a first coefficient variable in response to the output of said exhaust gas concentration sensor and at least one second coefficient variable in response to the output of said particular operating conditions detecting means, said first and second coefficients forming factors for determining the air/fuel ratio; and of said air/fuel mixture, said electric circuit means including a comparator for comparing an output value of said exhaust gas concentration sensor with a predetermined reference value to generate a binary signal indicative of the difference between and two values, means responsive to said binary signal to correct the value of said first coefficient by means of integral term control in a manner reversing the direction of correcting the value of said first coefficient upon each inversion in the level of said binary signal, means operable when said engine is operating in an operating condition other than said particular operating conditions, to cause said first coefficient correcting means to perform said first coefficient value correction responsive to said output value of said exhaust gas concentration sensor, and simultaneously hold the value of said second coefficient at a first predetermined value, and means operable when said engine is operating in one of said particular operating conditions, to hold the value of said second coefficient at a second predetermined value and simultaneously hold the value of said first coefficient at a third predetermined value which is a mean value of values of said first coefficient obtained under a predetermined condition when said engine is operating in said operating condition other than said particular operating conditions, wherein said mean value of said first coefficient comprises a mean value of values of said first coefficient obtained through a plurality of inversions in the level of said binary signal outputted from said comparator, occurring immediately before said engine comes into said one particular operating condition, said means value being obtained by said first coefficient correcting means when each inversion occurs in the level of said binary signal outputted from said comparator, and wherein said mean value of said first coefficient is calculated by the following equation:

$$KREF = \frac{1}{B} \sum_{j=1}^{B} KO_{2j}$$

where $KO_{2j}$ represents a value of said first coefficient obtained at a first one of a j-number of inversions in the level of said binary signal taking place before the present one, and B a constant equal to a number of inversions of in the level of said binary signal which are subjected to calculation of the mean value.

* * * * *

UNITED STATES PATENT AND TRADEMARK OFFICE

CERTIFICATE OF CORRECTION

PATENT NO. : 4,445,482

DATED : May 1, 1984

INVENTOR(S) : Hasegawa et al.,

It is certified that error appears in the above-identified patent and that said Letters Patent are hereby corrected as shown below:

At column 9, line 17, equation (6) reading, $$KREF = \frac{CREF}{A} \times KO_{2p} + \frac{A-CREF}{A} \times KREF$$ should read, $$KREF = \frac{CREF}{A} \times KO_{2p} + \frac{A-CREF}{A} \times KREF'$$

At column 20, line 12, the formula reading, $\frac{A-CREF}{A} \times KREF$, should read, $\frac{A-CREF}{A} \times KREF'$ At column 20, line 22, the formula reading, $\frac{A-CREF}{A} \times KREF$, should read, $\frac{A-CREF}{A} \times KREF'$ At column 20, line 30, the formula reading, $$\frac{CREF}{A} \times KO_{2p} + \frac{A-CREF}{A} \times KREF,$$ should read, $$\frac{CREF}{A} \times KO_{2p} + \frac{A-CREF}{A} \times KREF'$$

At column 20, line 45, the formula reading, $\frac{A-CREF}{A} \times KREF$, should read, $\frac{A-CREF}{A} \times KREF'$

UNITED STATES PATENT AND TRADEMARK OFFICE

CERTIFICATE OF CORRECTION

PATENT NO. : 4,445,482

DATED : May 1, 1984

INVENTOR(S) : Hasegawa et al.,

It is certified that error appears in the above-identified patent and that said Letters Patent are hereby corrected as shown below:

At column 20, line 61, the formula reading, $\frac{CREF}{A} \times KREF$, should read, $\frac{CREF}{A} \times KREF'$ At column 21, line 11, the formula reading, $\frac{A-CREF}{A} \times KREF$, should read, $\frac{A-CREF}{A} \times KREF'$ At column 21, lines 15 to 20, the equation reading, $$KREF - \frac{CREF}{A} \times KREF = \frac{A}{A} \times KREF - \frac{CREF}{A} \times KREF = \frac{A-CREF}{A} \times KREF,$$

should read, $$KREF' - \frac{CREF}{A} \times KREF' = \frac{A}{A} \times KREF' - \frac{CREF}{A} \times KREF' = \frac{A-CREF}{A} \times KREF'$$

At column 26, line 65 the equation reading, $$KREF = \frac{CREF}{A} \times KO_{2p} + \frac{A-CREF}{A} \times KREF, \text{ should read,}$$

$$KREF = \frac{CREF}{A} \times KO_{2p} + \frac{A-CREF}{A} \times KREF'$$

UNITED STATES PATENT AND TRADEMARK OFFICE

CERTIFICATE OF CORRECTION

PATENT NO. : 4,445,482

DATED : May 1, 1984

INVENTOR(S) : Hasegawa et al.,

It is certified that error appears in the above-identified patent and that said Letters Patent are hereby corrected as shown below:

At column 27, line 32, the equation reading,

"$KREF = \frac{CREF}{A} \times KO_{2p} + \frac{A-CREF}{A} \times KREF$", should read, -- $KREF = \frac{CREF}{A} \times KO_{2p} + \frac{A-CREF}{A} \times KREF'$ --

At column 28, line 55, the equation reading,

"$KREF = \frac{CREF}{A} \times KO_{2} + \frac{A-CREF}{A} \times KREF$", should read, -- $KREF = \frac{CREF}{A} \times KO_{2} + \frac{A-CREF}{A} \times KREF'$ --

At column 30, line 35, the equation reading,

"$KREF = \frac{CREF}{A} \times KO_{2p} + \frac{A-CREF}{A} \times KREF$", should read, -- $KREF = \frac{CREF}{A} \times KO_{2p} + \frac{A-CREF}{A} \times KREF'$ --

UNITED STATES PATENT AND TRADEMARK OFFICE

CERTIFICATE OF CORRECTION

PATENT NO. : 4,445,482

DATED : May 1, 1984

INVENTOR(S) : Hasegawa et al.,

It is certified that error appears in the above-identified patent and that said Letters Patent are hereby corrected as shown below:

At column 32, line 30, the equation reading,

"$KREF = \frac{CREF}{A} \times KO_{2p} + \frac{A-CREF}{A} \times KREF$", should read, -- $KREF = \frac{CREF}{A} \times KO_{2p} + \frac{A-CREF}{A} \times KREF'$ --

At column 34, line 15, the equation reading,

"$KREF = \frac{CREF}{A} \times KO_{2} + \frac{A-CREF}{A} \times KREF$", should read, -- $KREF = \frac{CREF}{A} \times KO_{2} + \frac{A-CREF}{A} \times KREF'$ --

Signed and Sealed this

*Sixteenth* Day of *October 1984*

[SEAL]

*Attest:*

*Attesting Officer*

GERALD J. MOSSINGHOFF

*Commissioner of Patents and Trademarks*